US005080727A

United States Patent [19]

Aihara et al.

[11] Patent Number: 5,080,727

[45] Date of Patent: Jan. 14, 1992

[54] METALLIC MATERIAL HAVING ULTRA-FINE GRAIN STRUCTURE AND METHOD FOR ITS MANUFACTURE

[75] Inventors: Kenji Aihara, Kitakyushu; Chihiro Hayashi, Takarazuka; Takashi Tsukamoto, Kitakyushu; Nobuhiro Murai, Kitakyushu; Hyoji Hagita, Kitakyushu, all of Japan

[73] Assignee: Sumitomo Metal Industries, Ltd., Osaka, Japan

[21] Appl. No.: 446,457

[22] Filed: Dec. 5, 1989

[30] Foreign Application Priority Data

| | | | |
|---|---|---|---|
| Dec. 5, 1988 | [JP] | Japan | 63-307608 |
| May 11, 1989 | [JP] | Japan | 1-117679 |
| May 11, 1989 | [JP] | Japan | 1-117680 |
| May 11, 1989 | [JP] | Japan | 1-117681 |
| May 15, 1989 | [JP] | Japan | 1-121244 |
| May 15, 1989 | [JP] | Japan | 1-121245 |
| May 16, 1989 | [JP] | Japan | 1-122275 |
| May 19, 1989 | [JP] | Japan | 1-126254 |
| May 22, 1989 | [JP] | Japan | 1-128535 |
| Jun. 5, 1989 | [JP] | Japan | 1-142345 |
| Jun. 23, 1989 | [JP] | Japan | 1-162398 |

[51] Int. Cl.[5] ..... C21D 8/00

[52] U.S. Cl. ..... 148/11.5 R; 148/12 R; 148/12 E; 148/12 EA; 148/12 B; 148/11.5 F; 148/11.5 N; 148/320; 72/709

[58] Field of Search ..... 72/364, DIG. 709, 53, 72/342.1, 342.5, 202, 201; 140/11.5 R, 12 R, 12 E, 12 EA, 12 B, 11.5 N, 11.5 F; 148/320

[56] References Cited

U.S. PATENT DOCUMENTS

| | | | |
|---|---|---|---|
| 3,278,345 | 10/1966 | Grange et al. | 148/12.4 |
| 3,481,799 | 12/1969 | Day et al. | 148/11.5 F |
| 3,489,617 | 1/1970 | Wuerfel | 148/11.5 F |
| 4,045,254 | 8/1977 | Deguchi | 148/12 R |
| 4,466,842 | 8/1984 | Yada et al. | 148/12 R |
| 4,675,964 | 6/1987 | Allison | 148/11.5 R |
| 4,729,546 | 3/1988 | Allison | 251/368 |

FOREIGN PATENT DOCUMENTS

| | | | |
|---|---|---|---|
| 89122371 | 4/1990 | European Pat. Off. . | |
| 2501048 | 7/1976 | Fed. Rep. of Germany . | |
| 58-64316 | 4/1983 | Japan | 148/12 R |
| 61-056233 | 3/1986 | Japan . | |
| 1171542 | 8/1985 | U.S.S.R. | 148/12 R |

*Primary Examiner*—Deborah Yee
*Attorney, Agent, or Firm*—Swecker & Mathis

[57] ABSTRACT

A method for producing a metallic material having an ultra-fine microstructure, the metallic material exhibiting a phase transformation of a low-temperature phase into a high-temperature phase is disclosed, the method comprising the steps of:

preparing a metallic material which comprises at least a low-temperature phase;

applying plastic deformation to the metallic material; and increasing the temperature of the metallic material to a point beyond a transformation point while applying the plastic deformation to effect reverse transformation of the low-temperature phase into a high-temperature phase.

30 Claims, 1 Drawing Sheet

METALLIC MATERIAL HAVING ULTRA-FINE GRAIN STRUCTURE AND METHOD FOR ITS MANUFACTURE

BACKGROUND OF THE INVENTION

This invention relates to a metallic material as well as a method for manufacturing it from a high-temperature phase having an ultra-fine microstructure of a metal, the metal including an alloy which exhibits a phase transformation of a low-temperature phase into a high-temperature phase and vice versa. This invention also relates to a method for achieving an ultra-fine grain structure in a high-temperature phase as well as in a low-temperature phase derived from the high-temperature phase.

The terms "high-temperature phase" and "low-temperature phase" are used to mean phases appearing at a temperature higher or lower, respectively, than a transformation temperature, and the term "metal" is used to include a variety of metals in which a low-temperature phase is transformed into a high-temperature phase, such as steel, Ti, Ti-base alloys, Zr, Zr-base alloys, Ni, and Ni-base alloys. In the case of steel, the high-temperature phase is austenite and the low-temperature phase is ferrite, or the high-temperature phase is $\delta$-ferrite and the low-temperature phase is $\gamma$-austenite and in the case of titanium the former is $\beta$-phase and the latter is $\alpha$-phase. For brevity, however, this invention will be described using steel and Ti-base alloys as examples, and the low-temperature phase is ferrite or $\alpha$-phase and the high-temperature phase is austenite or $\beta$-phase.

It is well known that refining the grain structure of a metal produces improvements in properties of the metal such as its low temperature toughness, ductility, yield strength, corrosion resistance, and superplasticity. Thus, many processes to prepare a fine metallic structure have been developed.

However, prior art methods for refining the grain structure of a metal can attain a grain size of no smaller than 20 $\mu$m in diameter. An industrial manufacturing method to provide a grain structure having an average grain size of 10 $\mu$m or smaller in diameter, and generally 15 $\mu$m or smaller has not yet been developed.

One industrial method for grain refining is the controlled rolling method. This is a method for preparing a fine grain structure for a hot-rolled steel material by controlling the hot rolling conditions, such as by lowering the finishing temperature to as low a level as possible. However, it is extremely difficult to obtain austenitic grains of the high-temperature phase which are 15 $\mu$m or smaller in diameter. Therefore, there is a limit to the grain size of a ferritic structure which is derived from the above-described austenitic grains, and it has been thought to be impossible from a practical viewpoint to obtain a uniform and ultra-fine ferritic grain structure comprising grains having an average diameter of 10 $\mu$m or smaller, especially 5 $\mu$m or smaller.

The so-called accelerating cooling method has been developed for refining the grain size in a ferritic steel. In this method, the cooling rate is controlled after the completion of controlled rolling so as to increase the number of nuclei for the growth of ferritic crystal grains to further refine the crystal grains. However, according to this method, refinement of an austenitic structure before transformation occurs only during controlled rolling, and is not influenced by the subsequent cooling rate. Thus, there is still a limit to the grain size of an austenitic microstructure before transformation, and it is impossible to obtain a uniform, ultra-fine grained austenitic structure. Since austenitic grains are rather large, the martensite derived therefrom does not have a fine-grained structure.

Japanese Patent Publication No. 42021/1987 discloses a method of manufacturing hot rolled steel articles which comprises hot working a low-carbon steel with a high degree of deformation at a temperature higher than the transformation temperature to form a fine-grained ferritic structure so that recrystallization of austenitic grains can be prevented, and carrying out accelerated cooling to form bainite or martensite as well as to effect refinement of the thus-formed bainite or martensite. According to this method, a quenched structure which comprises ferritic grains having an average grain size of about 5 $\mu$m with the balance being bainite or martensite can be obtained. However, the resulting bainite or martensite has an average grain size of 20–30 $\mu$m. This is rather large.

The Japanese journal "Iron and Steel" Vol. 74 (1988) No. 6, pp. 1052–1057 discloses a method of manufacturing an ultra-fine austenitic grain structure by cold working an austenitic stainless steel (Fe-13/18 wt % Cr-8/12 wt % Ni) at room temperature to effect a strain-induced transformation of austenite into martensite, and annealing the resulting martensite by heating it at a temperature within a stable austenitic region to carry out reverse transformation of martensite into austenite, resulting in an ultra-fine austenitic grain structure. According to this method, a hot rolled stainless steel is subjected to cold rolling or a sub-zero treatment at a temperature lower than room temperature, and then is heated to a temperature in an austenitic region. This process corresponds to a conventional solution heat treatment of an austenitic steel. Such an ultra-fine microstructure can be obtained only for an austenitic high Cr-, high Ni stainless steel having a reverse transformation temperature of 500°–600° C. Therefore, as a general rule, it is impossible to obtain an austenitic microstructure having a grain size of 15 $\mu$m or smaller for a common steel by the above-described method.

SUMMARY OF THE INVENTION

It is a general object of this invention to provide a metallic material comprising a high-temperature phase of a uniform and ultra-fine grain structure and a method for producing the metallic material comprising such a high-temperature phase, the metallic material exhibiting a phase transformation of a low-temperature phase into a high-temperature phase.

It is a more specific object of this invention to provide a metallic material comprising a high-temperature phase of a uniform and ultra-fine grain structure, which in the case of steel is an austenitic phase, the high-temperature structure having a grain size of 15 $\mu$m or smaller, preferably 10 $\mu$m or smaller and a method for producing the metallic material.

It is another object of this invention to provide a metallic material comprising a uniform, ultra-fine grain structure, such as ferrite, martensite, bainite, or pearlite having an average grain size of 10 $\mu$m or smaller, preferably 5 $\mu$m or smaller, and a method of producing the metallic material from the before-mentioned uniform, ultra-fine austenitic structure.

It is still another object of this invention to provide titanium or a titanium alloy having a uniform, ultra-fine grained microstructure, and a method for producing such a uniform, ultra-fine grained microstructure.

The inventors of this invention made the following discoveries.

(a) When steel which is phase-transformable between an austenitic phase and a fenitic phase is processed, i.e., when a metal which is phase-transformable between a high-temperature phase and a low-temperature phase is processed by hot working, as a pretreatment the metal is first subjected to a thermal treatment or deformation such as in conventional hot working so as to control the microstructure such that at least part of the metallic structure comprises a low-temperature phase, and as a final step the temperature of the metal is increased to a point beyond the transformation temperature while plastic deformation is applied to the metal to effect a reverse transformation of the low-temperature phase into the high-temperature phase, resulting in an unexpectedly ultra-fine microstructure which cannot be obtained by conventional controlled rolling.

(b) The above-described ultra-fine high-temperature microstructure can be obtained from a starting material which mainly comprises a low-temperature phase by first carrying out deformation in a low temperature region and a warm-temperature region, and then at the final stage of working by increasing the temperature beyond the phase transformation temperature while performing working to effect reverse transformation.

(c) In order to complete the above-described reverse transformation, it is preferable that the metallic material being processed be maintained at a prescribed temperature, e.g., at a temperature higher than the $Ac_1$ point in equilibrium conditions for a given length of time after the temperature rise caused by plastic deformation has ended.

(d) The thus-obtained steel material having an ultra-fine, austenitic grain structure may be further subjected to a conventional treatment including air cooling, slow cooling, holding at high temperatures, accelerated cooling, cooling combined with deforming, quenching, or a combination of such treatments. The resulting steel product has a uniform and ultra-fine grain structure which has never been obtained in the prior art.

In particular, when slow cooling is performed, a spheroidized or softened and annealed ultra-fine microstructure can be obtained. In addition, when the above-described austenitic steel is rapidly cooled only in a high temperature range without crossing a nose area of the CCT curve for the steel, a uniform, ultra-fine quenched microstructure can be obtained in a relatively easy manner.

In the case of steel, the resulting metallurgical structure is austenite, ferrite, bainite, martensite, or pearlite, which is determined depending on the heat treatment conditions employed.

(e) Furthermore, according to this invention, in the case of a hot-worked steel product, since the steel product is subjected to the phase transformation "ferrite→austenite→ferrite", carbides and nitrides which have been precipitated during working and are effective to further strengthen steel are not longer coherent with the matrix with respect to their crystal lattice. The mechanism of strengthening steel is changed from "coherent precipitation strengthening" to "incoherent precipitation strengthening". Thus, it is possible to achieve precipitation strengthening without embrittlement. This is very advantageous from a practical viewpoint.

This invention is based on the above findings. In a broad sense it resides in a metallic material and a method for producing the same in which the metallic material is phase-transformable between a low-temperature phase and a high-temperature phase, plastic deformation is applied when the material comprises at least a low-temperature phase, and the temperature of the material is raised beyond the transformation temperature to the temperature of the high-temperature phase while applying plastic deformation. The metallic material the temperature of which has been raised beyond the phase transformation point may be retained at such a high temperature. The resulting high-temperature structure has an ultra-fine grain structure.

The metallic material to which this invention can be applied is not restricted to any specific one so long as it has a phase transformation point from a low-temperature phase to a high-temperature phase. Examples of such metallic materials are steel, Ti, Ti-alloys, Zn, Zn-alloys, Ni, and Ni alloys.

In the case of steel, the low-temperature phase is ferrite and the high-temperature phase is austenite, and it may be the case in which the low-temperature phase is $\gamma$-austenite and the high-temperature phase is $\delta$-ferrite. In the former case, a steel comprising at least a ferritic phase can be used as a starting material for hot working.

The term "steel" is used to include carbon steels, alloyed steels, and any other types having a structure comprising at least a ferritic phase, although it contains other additional elements.

"Steel comprising at least a ferritic phase" means steels comprising ferrite only as well as steels comprising a combined phase of ferrite with at least one of carbides, nitrides, and intermetallic compounds, steels comprising a combined phase of ferrite with austenite, and steels comprising a combined phase of ferrite with austenite and at least one of carbides, nitrides, and intermetallic compounds.

According to this invention, not only carbon steel but also a variety of alloyed steels can be successfully treated to provide a hot-worked, high-strength steel having an ultra-fine microstructure without adverse effects which might be caused by alloying elements.

The term "ferrite phase" or "ferrite structure" means a structure which comprises a ferritic phase distinguishable from an austenitic phase, including an equiaxed ferrite, acicular ferrite, and a ferrite-derived structure such as a bainite structure, martensite structure, or tempered martensite.

DETAILED DESCRIPTION OF THE PREFERRED EMBODIMENTS

Figure 1:
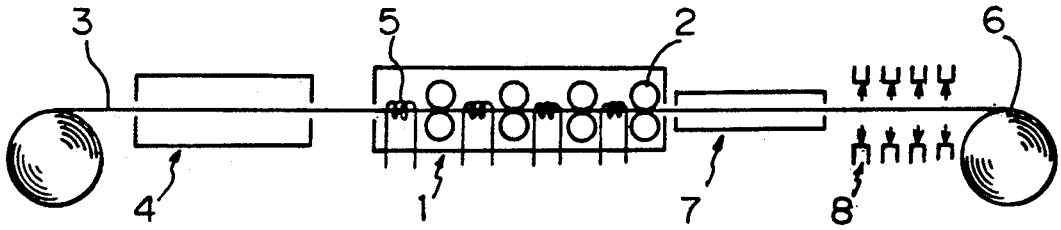
FIG. 1 is a schematic illustration of a hot rolling production line by which the method of this invention can be performed.

FIG. 1 shows a hot rolling production line which can be used in this invention.

In FIG. 1, an induction heating furnace 1 covers a series of pair of rolls 2 and rolling is carried out within the furnace 1. In carrying out rolling, a steel rod 3 to be rolled is first heated by passing it through an infrared ray-heating furnace 4, and the heated rod is hot rolled within the induction-heating furnace 1 while further adjusting the temperature of rod by heating it with a series of induction heating coils 5 each of which is provided before each of the rolls. The rolled rod after leaving the final stage of rolling may be retained at a given temperature in a temperature-maintaining furnace 7 or it may be cooled slowly or it may be air-cooled or water-cooled with water-spray nozzles 8. The thus heat-treated rolled rod is then coiled by a coiler 6.

According to the method of this invention a starting microstructure for hot rolling is defined as a microstructure comprising at least a low-temperature phase, i.e., a single low-temperature phase microstructure or a microstructure mainly comprising the low-temperature phase, which is ferrite in the case of steel.

While plastic deformation is applied, the ferrite is transformed into an austenitic phase so that an ultra-fine microstructure may be obtained. The resulting austenitic, ultra-fine grained structure, when subjected to further heat treatment, e.g. cooling, will have a uniform, ultra-fine transformed structure, such as an ultra-fine ferrite, martensite, bainite and pearlite.

In this invention, the greater the amount of ferrite the better for the starting material. However, sometimes it is rather difficult to obtain 100% ferrite structure or 100% ·(ferrite+carbides or nitrides or other precipitates) structure during working. In addition, some steel products inevitably contain ferrite+austenite, or ferrite+austenite+carbides or nitrides or other precipitates. Therefore, it is desirable that the amount of ferrite be 20% by volume or more, and preferably 50% by volume or more.

The amount of strain which is introduced during plastic deformation so as to effect reverse transformation of ferrite into austenite is preferably 20% or more for the purpose of this invention.

The introduction of strain during plastic deformation is effective, firstly, to induce ultra-fine austenitic grains from the work-hardened ferrite. Secondly, it is effective to generate heat during plastic working so that the temperature of the work piece is increased beyond the transformation temperature at which ferrite is transformed into austenite. Thirdly, it is effective to produce work hardening in the resulting fine austenitic grains so that ultra-fine ferritic grains can be induced when followed by transformation into ferrite.

However, when the amount of strain is less than 20%, the formation of ultra-fine austenitic grains induced by deformation during the reverse transformation is sometimes not enough to obtain a grain size of not larger than 15 μm. Furthermore, when the strain is less than 20%, the amount of heat generated during working is so small that an auxiliary heating means should be provided in order to promote the reverse transformation of ferrite into austenite. This is disadvantageous from an economical viewpoint.

In contrast, when the amount of strain is larger than 50%, there is no need for an additional heating means to effect the reverse transformation if the final shape of the steel product and the working speed are selected suitably. Therefore, the amount of strain is preferably 50% or higher.

Means for providing strains to steel materials during working is not restricted to any specific one. It includes, for example, rolling mills such as strip rolling mills, pipe rolling mills, and rolling mills with grooved rolls, piercing machines, hammers, swagers, stretch-reducers, stretchers, and torsional working machines.

Alternatively, such strains can be imparted solely by shot-blasting, which is a particularly easy and effective way to apply plastic deformation to wire. In carrying out shot-blasting, it is preferable to strike shot against the wire from four directions, i.e., from above and below and from right and left. The shot may be in the form of steel balls which are usually used to perform descaling under cold conditions. The diameter of the shot is preferably as small as possible.

Needless to say, it is necessary to heat the steel being hot worked to a temperature higher than the point at which ferrite is transformed into austenite, i.e., the $Ac_1$ point in order to perform reverse transformation of ferrite into austenite. When the temperature is higher than the $Ac_1$ point but lower than the $Ac_3$ point, the resulting phase structure is a dual-phase structure comprising ferrite and austenite. According to this invention, however, since deformation is carried out while increasing the temperature, the size of crystal grains is thoroughly reduced due to plastic deformation and recrystallization even if the temperature does not increase to higher than the $Ac_3$ point. The rise in temperature is restricted to lower than the $Ac_3$ point when the production of a dual-phase structure comprising ferrite and austenite is required.

According to this invention, as already mentioned, the reverse transformation is carried out by applying plastic deformation and by simultaneously increasing the temperature.

The purpose of carrying out the reverse transformation are to refine the ferrite grains by working in a ferrite-forming temperature range, to promote the work-induced formation of fine austenitic grains from work-hardened ferrite grains, to refine the austenite grains by working, and to promote the strain-induced transformation of work-hardened austenite grains into fine ferritic grains.

When the starting structure for the reverse transformation contains carbides, the carbides are mechanically crushed into fragments which are then uniformly dispersed throughout the matrix during the above-mentioned plastic deformation. Furthermore, such fine carbides constitute nuclei for transformation of ferrite into austenite to promote the formation of finer grains of austenite. Working is effective for accelerating the decomposition of carbides and their incorporation into a solid-solution, and the decomposition of carbides also accelerates the reverse transformation into austenite.

When carrying out hot working and heating of steel so as to effect the reverse transformation into austenite in accordance with this invention, there is a tendency for the rate of deformation to be high and therefore for the temperature to rise rapidly. In fact, sometimes there is not enough time to complete the reverse transformation into austenite before cooling. In such a situtation the hot-worked steel might be cooled before deformed ferrite is thoroughly transformed into austenite, and large grains of ferrite will remain without being transformed.

Therefore, after hot working is completed and the temperature is increased to a point higher than the transformation point, it is preferable that the resulting hot-worked steel material be kept at a temperature higher than the $Ae_1$ point so as to allow sufficient time for the ferrite grains containing strains to transform into austenite. For this purpose the rolled material can be held at a temperature higher than the $Ae_1$ point. If it is held at a temperature lower than the $Ae_1$ point, the reverse transformation will no longer take place for the reasons of thermodynamic principles.

A necessary period of time for hot-worked metallic material to be maintained at a temperature higher than the $Ae_1$ point is preferably determined based on the working conditions and the kind of metallic material. A period of as little as 1/100 seconds is enough for highly-pure iron metal, while some types of high-alloy steel require several tens of minutes to complete the reverse transformation. In general, one hour at the longest is enough for high-alloyed steels which are widely used today in industry. Therefore, it is desirable to employ a retaining time which is long enough to complete transformation and is reasonable from the viewpoint of economy to ensure proper operating efficiency. Thus, according to this invention the upper and lower limits are not restricted to specific ones.

After finishing the reverse transformation of this invention, direct annealing may be applied to the hot-rolled product by controlling the cooling rate. Such a heat treatment is already known in the art.

When applying annealing, the suitable cooling rate is rather slow and it depends on the desired product as well as the intended transformed structure which includes, for example, a well-recovered, soft ferrite having an ultra-fine grain structure, an ultra-fine grain structure comprising an ultra-fine ferrite and spherical carbides, and an annealed, ultra-fine structure comprising ferrite and spherical carbides or soft pearlite, which is free from a quenched structure such as martensite and bainite. The cooling rate is not restricted to a specific one, and a suitable one can be chosen based on the above factors and practical considerations.

According to this invention, a quenched structure can be obtained. Namely, the resulting austenitic structure, i.e., the structure of a high-temperature phase comprising ultra-fine grains can be quenched to provide an ultra-fine martensite structure. However, as is well known, the finer the austenitic grains the worse is the hardenability. Since the transformation temperature from austenite to ferrite shifts to a higher position for an austenite having a finer microstructure, more coarse ferritic grains are easily formed for an austenite having finer grains even if the same cooling rate is employed. This is contrary to the purpose of providing a steel product having an ultra-fine microstructure by refining an austenitic structure.

Figure 2:
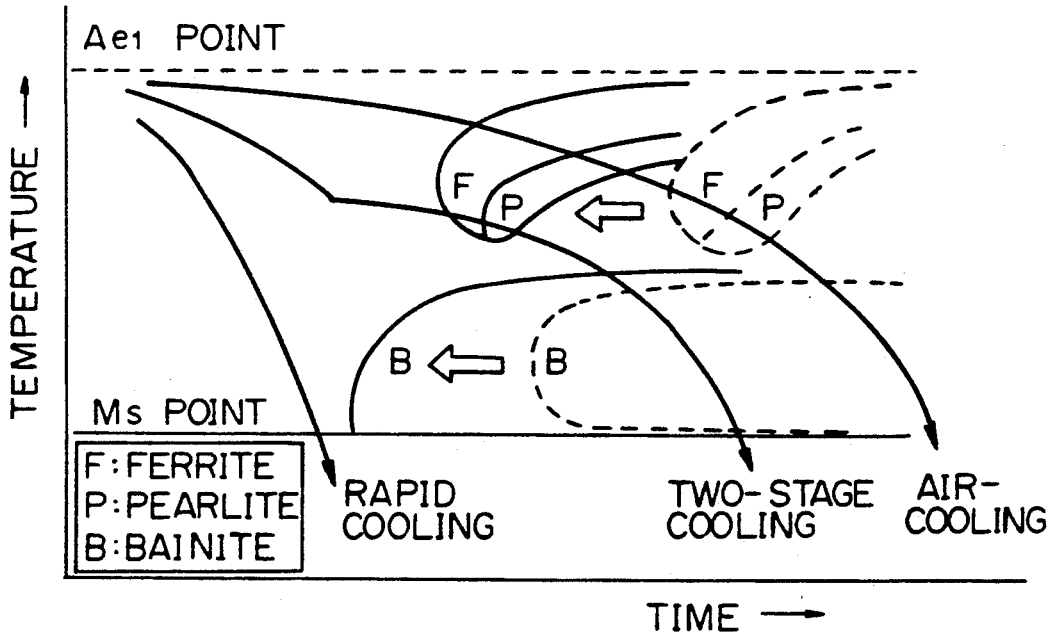
FIG. 2 is a graph showing a CCT curve for steel.

In addition, the nose area of a CCT curve moves towards the short-time side as shown by a white arrow in FIG. 2 when the austenite comprises finer grains, and it is rather difficult to obtain a quenched structure, but ferrite/pearlite are easily formed. In this case the bainite-forming region also moves towards the short-time side.

Therefore, in order to obtain an ultra-fine, quenched microstructure in spite of these problems it is necessary to carry out rapid cooling at a rate higher than the critical cooling rate so as not to cross the nose area of the CCT curve. Such rapid cooling can be performed using a large amount of a cooling medium such as water, oil, or air, or it can be performed by spraying such a cooling medium against an object to be cooled at a high pressure and at high speed.

However, the cooling rate is usually higher in a high-temperature region than in a low-temperature region. Therefore, in order to avoid passing through the nose area of the CCT curve, rapid cooling is carried out only in a high temperature region, i.e., in a temperature region from the $Ae_1$ point to the Ms point. This is advantageous from the industrial point of view.

In a preferred embodiment of this invention, after quenching in the above-manner, a quenched structure may be slowly cooled. Such slow cooling may be accomplished by air cooling or natural cooling, too.

Thus, according to this invention, a high-temperature phase with an ultra-fine microstructure of the high-temperature phase can be obtained, and the resulting ultra-fine high-temperature phase can be further heat treated to produce the following various steel materials.

(1) Ultra-fine ferritic steels:

When the above-described ultra-fine austenite is cooled from its high-temperature state under usual ferrite-forming conditions, according to this invention, a steel mainly comprising a ferritic structure of equiaxed ferritic grains is obtained. The steel exhibits excellent properties when the grain size is 5 μm or less.

The equiaxed ferrite is distinguishable from non-equiaxed ferrite which is included in pearlite, bainite and martensite.

(2) Ultra-fine bainitic steels:

When the above-described ultra-fine austenite is cooled from its high-temperature state under usual bainite-forming conditions, according to this invention, a steel mainly comprising a bainitic structure of ultra-fine bainitic packet is obtained. The steel exhibits excellent properties including good workability, strength, and toughness when the packet size is 5 μm or less.

The bainite packet is a region in which the longitudinal axes of the bainitic grains are aligned.

(3) Ultra-fine martensitic steels:

When the above-described ultra-fine austenite is cooled from its high-temperature state under the before-mentioned martensite-forming conditions, according to this invention, a steel mainly comprising a martensitic structure of ultra-fine martensitic packet is obtained. The steel exhibits excellent properties including good workability, strength, and toughness when the packet size is 5 μm or less.

The martensitic packet is a region in which the longitudinal axes of the martensitic grains are aligned.

In the case of the above ultra-fine, martensitic carbon steel or alloyed steel having a carbon content of 0.6% by weight or less, when tempering is carried out at a temperature lower than the $Ac_1$ point, a highly-ductile PC steel can be obtained which has a relaxation value of 1.5% at room temperature, a relaxation value of 10% or less at warm temperatures, a tensile strength of 95 $kgf/mm^2$ or higher, and uniform elongation of 3.0% or more. During tempering, deformation with a total of plastic strains of 3–90% may be applied.

(4) Ultra-fine pearlitic steels:

When the above-described ultra-fine austenite of high carbon steel is cooled from its high-temperature state under usual pearlite-forming conditions, according to this invention, a steel mainly comprising a pearlite structure of ultra-fine pearlite grains is obtained. The steel exhibits excellent workability when the average pearlite colony size is 5 μm or less.

A pearlite colony is a region of pearlite structure in which ferrite lamellae and cementite lamellae are aligned in the same direction.

When a steel having a carbon content of 0.70–0.90% is used for the above described ultra-fine, pearlitic steel and controlled cooling such as lead patenting or air-blasting is applied to the ultra-fine austenitic structure after completion of the reverse transformation, a filament which can be successfully used as cord for automobile tires is obtained. A conventional wire has a strength of at most 320 kgf/mm$^2$. In contrast, according to this invention a wire having a tensile strength of 380 kgf/mm$^2$, 20 twists or more, and a probability of fracture by bending of 5% or less and which is suitable for wire drawing can be obtained.

The types and compositions of the above-described steels are not restricted to any specific ones so long as an intended ultra-fine microstructure can be attained. Furthermore, if necessary, at least one alloying element such as B, V, Nb, Ti, Zr, W, Co, and Ta can be added. Depending on the purpose of the steel, a rare earth metal such as La and Ce and an element which promotes free-cutting properties such as Ca, S, Pb, Te, Bi, and Te can be added.

This invention can be applied to any metallic materials which exhibit a phase transformation from a low-temperature phase to a high-temperature phase and vice versa, such as titanium and titanium alloys. In the case of titanium and titanium alloys, the high-temperature phase corresponds to $\beta$-phase and the low-temperature phase corresponds to $\alpha$-phase.

According to one embodiment of this invention, titanium material comprising at least an $\alpha$-phase is hot-worked to increase its temperature to a point higher than the transformation point while carrying out plastic deformation with plastic strains of 20% or more. It is then kept at this temperature for not longer than 100 seconds to perform the reverse transformation of at least part of the $\alpha$-phase into $\beta$-phase. It is then cooled to obtain titanium or a titanium alloy with an ultra-fine microstructure.

In the case of titanium or a titanium alloy, it is preferable that the particle size of the resulting $\beta$-phase grains, i.e., the particle size of the $\beta$-phase grains before cooling be 100 $\mu$m or smaller. It is well known in the art that the particle size of $\beta$-phase grains can be easily and accurately determined on the basis of the arrangement of $\alpha$-phase grains, the etched surface appearance, and the like.

The structure "comprising at least an $\alpha$-phase" means not only a structure comprising $\alpha$-phase only, but also a structure comprising a combined phase of $\alpha$-phase with precipitated phases of rare earth metals and/or oxides of rare earth metals, a structure comprising a combined phase of $\alpha$-phase with $\beta$-phase, and a structure comprising a combined phase of $\alpha$-phase with $\beta$-phase and precipitated phases of rare earth metals and/or oxides of rare earth metals.

After finishing the reverse transformation into $\beta$-phase, the titanium or titanium alloy is cooled. Rapid or slow cooling can be performed.

This invention will be further described in conjunction with the following working examples which are presented merely for illustrative purposes.

EXAMPLE 1

The steel compositions shown in Table 1 were melted in air using an induction heating furnace and were poured into 3-ton ingots. After soaking, the ingots were hot-rolled to form square bars each measuring 130×130 mm in section. The bars were divided into 100 kg pieces which were then hot-forged to form billets measuring 50×30 mm in section.

For Steel A through Steel H the resulting billets were heated to 950° C. to give normalized structures. For Steel I and Steel J the resulting billets were heated to 1150° C. and furnace-cooled. The resulting heat-treated billets were then rolled to form billets measuring 9 mm, 10 mm, 12 mm, 15 mm, 20 mm, or 25 mm in thickness and 30 mm in width. For Steel A through Steel H the resulting billets were again heated to 950° C. to give normalized structures. For Steel I and Steel J the resulting billets were heated to 1150° C. and furnace-cooled to prepare stock for rolling.

EXPERIMENT i

The thus-prepared rolling billets of Steel A through Steel K measuring 20 mm×30 mm were heated in an induction heating furnace to the temperatures indicated in Table 2 and were hot rolled to plates measuring 7.5 mm in thickness in a single pass using a planetary mill.

As shown in Table 2, the structure prior to hot rolling was a single phase of ferrite, a combined structure of ferrite with austenite or a combined structure of ferrite with austenite further containing carbides, or intermetallic compounds.

The temperature of the rolled plates at the outlet of the rolling mill was increased by the heat generated during severe working with the planetary mill to the temperatures indicated as "finishing temperatures" in Table 2. It was confirmed that the temperature to be attained can be controlled by varying the rolling speed.

After hot-rolling the structures of eight steel samples including Steel A through Steel H were determined. The ferritic grain size was measured for the samples which had been air-cooled after hot rolling. The original austenitic grain size was measured by preferentially etching original austenitic grain boundaries for samples which has been water-quenched after rolling.

For comparison, stock of Steel A and Steel E measuring 20 mm×30 mm in section was heated to 950° C. and was then hot rolled at temperatures of 850°-825° C. with three passes using an experimental mill for rolling plates. This process was referred to as "controlled rolling". For further comparison, after controlled rolling, some of the samples were cooled rapidly to 650° C. by water-spraying and then air-cooled. This process was referred to as "controlled rolling+rapid cooling". The austenitic grain size was measured on a structure which after controlled rolling had been brine-quenched and then tempered.

The results of measurements are also shown in Table 2.

EXPERIMENTS ii

Steel G was used as stock for rolling. Six types of billets of Steel G measuring 9 mm, 10 mm, 12 mm, 15 mm, 20 mm, or 25 mm in thickness were hot rolled with various degrees of working.

For the billets having a thickness of 9 mm and 10 mm, hot rolling was carried out using the above-mentioned planetary mill to a thickness of 7.5 mm with one pass as in Experiment (i). Since in these cases the temperature of the rolled plates just after rolling increased to only 765° C. and 790° C., respectively, the temperature was increased rapidly by heating the plates to 905° C. with an induction heating coil disposed at the outlet of the mill. Some of the hot-rolled plates were retained at 905° C. for 5 seconds and then water cooled. The other plates were directly air-cooled without being held at 950° C.

On the other hand, for the billets having a thickness of 12 mm-20 mm, hot rolling was carried out using the planetary mill as in Experiment (i). However, this time the temperature of the plates just after rolling increased to 905° C. Some of the hot rolled plates were air-cooled immediately after finishing hot rolling, and the others were held at the outlet temperature for 5 seconds within the induction furnace disposed at the outlet of the mill and then water cooled.

Furthermore, the billet measuring 25 mm thick was subjected to four continuous passes of rolling with a reduction in 5 mm for each pass using an experimental mill for rolling plates and an induction heating furnace to obtain hot-rolled steel plates. Between each pass, heating with the induction heating furnace was performed to increase the temperature of the rolled plates by 50° C.

The test results are summarized in Table 3 together with processing conditions.

EXPERIMENT iii

Steel A and Steel G were used as stock for rolling. Plates of these steels measuring 20 mm thick were hot rolled in the same manner as in Experiment (i). The temperature of the rolled plates was increased at the outlet of the mill due to the heat generated during rolling, since the degree of deformation was large. The temperature which was reached depended on the rolling speed of the planetary mill. Therefore, the temperature of the plate after finishing rolling was adjusted by varying the rolling speed. Immediately after rolling some plates were water-cooled directly, and the others were held at the final rolling temperature for one minute by means of induction heating and then were water-cooled.

The test results are shown in Table 4 together with processing conditions.

EXPERIMENT iv

Steel D was used as stock for rolling. Billets of this steel with a thickness of 20 mm were first heated to 740° C., 780° C., or 850° C. in order to change the ratio of the area of austenite to the area of ferrite. The resulting plates were then hot rolled in the same manner as in Experiment (i). The finishing temperature was adjusted to be about 810° C. by controlling the rolling speed. In addition, the microstructure prior to hot rolling was examined on a material which, after heating, was quenched instead of being hot rolled. Immediately after rolling, the hot-rolled plates were water-cooled or air-cooled. The test materials designated as Run 4-7 and Run 4-8 were held at 810° C. for one minute after rolling.

The test results are shown in Table 5.

EXPERIMENT v

Billets of Steel G of Table 1 with a thickness of 20 mm were used as stock for rolling. The billets were heated to 875° C. in an infrared heating furnace and were then air-cooled to 675° C., 650° C., 625° C., or 600° C. prior to hot rolling. At the indicated temperatures the billets were hot rolled with the planetary mill in the same manner as in Experiment (i). The finishing temperature was adjusted to be about 850° C. by controlling the rolling speed. In addition, the same billet was heated to 875° C. and then was air-cooled to 675°-600° C. After quenching and tempering, without hot rolling, the grain size of the billet was observed. On the basis of observations, the microstructure prior to hot rolling was estimated.

Furthermore, plates of Steel G measuring 20 mm thick were prepared. Some of the plates were subjected to a patenting treatment in a salt bath to form bainite structure. The others were oil-quenched and then tempered at 200° C. The resulting plates were also used as stock for rolling. After hot rolling and the above-described post-treatment the resulting microstructure was observed.

The test results together with experimental conditions are summarized in Table 6.

EXPERIMENT vi

Rectangular bars of Steel I of Table 1 measuring 50 mm × 30 mm in section were heated to 200° C., and then were hot forged into rectangular bars measuring 20 mm × 30 mm in a temperature range of 1050°-700° C. by means of an air hammer. Following the hot-forging, the bars were held at 700° C. for from 5 minutes to 2 hours to form a combined structure comprising austenite, spherical carbides and nitrides, ferrite, and pearlite. After being removed from the furnace at 700° C., the hot-forged bars were hot rolled in the same manner as in Experiment (i), and then were air-cooled. The hot-rolled bars were cooled to room temperature and immediately tempered. The tempered bars were observed to determine the original grain size of austenite.

The test results together with experimental conditions are summarized in Table 7.

EXAMPLE 2

EXPERIMENT vii

In this experiment, the procedure of Experiment (i) was repeated except that the hot-rolled plates were retained at the finishing temperature for various periods of time of up to 1 hour. The grain size of ferritic grains of the asquenched structure was measured and determined as grain size before cooling. The grain size of austenitic grains before cooling was determined by measuring the grain size of a structure which had been subjected to tempering after quenching.

The test results are summarized in Table 8.

EXPERIMENT viii

In this experiment, the procedure of Experiment (ii) was repeated except that some of the processing conditions were changed as shown in Table 9.

The test conditions and results are summarized in Table 9.

EXPERIMENT ix

In this experiment, the procedure of Experiment (iii) was repeated using Steel A, Steel G, and Steel H except that some of the processing conditions were changed as shown in Table 10.

The test conditions and results are summarized in Table 10.

EXPERIMENT x

In this experiment, the procedure of Experiment (iv) was repeated except that some of the processing conditions were changed as shown in Table 11.

The test conditions and results are summarized in Table 11.

EXPERIMENT xi

In this experiment, the procedure of Experiment (v) was repeated except that some of the processing conditions were changed as shown in Table 12.

The test conditions and results are summarized in Table 12.

EXPERIMENT xii

In this experiment, the procedure of Experiment (vi) was repeated except that some of the processing conditions were changed as shown in Table 13.

The test conditions and results are summarized in Table 13.

In the preceding examples, plastic deformation was carried out by hot rolling in order to carry out reverse transformation. In another embodiment of this invention, the reverse transformation may be carried out by shot-blasting in place of hot rolling. It was confirmed that when shot-blasting was performed steel wire with an initial surface temperature of 710° C., it was possible to increase the surface temperature to 920° C.

EXAMPLE 3

In this example, the method of the present invention was used for the manufacture of titanium and titanium alloys.

Pure titanium and the titanium alloys shown in Table 14 were melted using a vacuum arc melting furnace and were poured into alloy ingots. These ingots were hot-forged with a heating temperature of 1500° C. and a finishing temperature of 1300° C. to provide rods measuring 60 mm×40 mm in section. Test pieces measuring 50 mm×30 mm in section were cut from the rods after annealing.

EXPERIMENT xiii

Pure titanium and titanium alloys (Sample A through Sample E) shown in Table 14 were prepared and were heated to the temperatures indicated in Table 15. After heating, they were hot-rolled to a thickness of 7.5 mm using a planetary mill or a conventional mill for rolling plate. When a conventional plate-rolling mill was used, rolling was carried out in three passes.

When rolling was carried using the planetary mill, the temperature of the plates at the outlet of the mill was increased due to the heat generated during rolling with a high degree of reduction. The temperature attained during rolling can be controlled by varying the rolling speed. In this experiment every sample could be heated to a temperature higher than its transformation temperature.

Immediately after the hot-rolling or after the plates were maintained at the finishing temperature for a period of time of up to 1 hour the resulting plates were water-cooled and then their microstructure was observed. The grain size of $\beta$-grains before water-cooling was determined by observing the microstructure of the stock for rolling.

The test results and processing conditions are summarized in Table 15.

EXPERIMENT xiv

Titanium Alloy C in Table 14 was used as stock for rolling. It was hot-rolled with a planetary mill. Heat generation was controlled by changing the degree of reduction in order to effect reverse transformation. After finishing rolling, the rolled plates were kept at the finishing temperature for 10 seconds, and then were water-cooled. The microstructure of the resulting titanium alloys was then observed.

The degree of reduction with the planetary mill, i.e., the amount of strain was adjusted to be 0%, 10%, 20%, 30%, 40% or 50%. This amount of reduction was not enough to increase the temperature thoroughly high over the transformation temperature of the alloy, an induction coil was disposed at the outlet of the mill and performed supplemental heating to heat the alloy to a temperature higher than the transformation temperature, e.g., 1050° C.

The observed grain sizes are summarized in Table 16.

EXAMPLE 4

In this example steel materials comprising mainly ferrite were prepared using the steel samples of Table 17 by controlling the cooling rate from austenite. The mechanical properties of these materials were determined and are shown in Table 18.

EXAMPLE 5

Steel materials comprising mainly bainite were prepared using Steel A through Steel E shown in Table 19 by controlling the cooling rate from austenite. The mechanical properties of these materials were determined and are shown in Table 20.

EXAMPLE 6

Steel materials comprising mainly martensite were prepared using steel samples shown in Table 21. The mechanical properties of these materials were determined and are shown in Table 22.

EXAMPLE 7

Steel materials comprising mainly pearlite were prepared using steel samples shown in Table 23. The mechanical properties of these materials were determined and are shown in Table 24.

EXAMPLE 8

Carbon steel (0.80% C-0.22% Si-0.51% Mn) was hot rolled using a heating temperature of 650° C., a finishing temperature of 900° C., a rate of temperature increase of 100° C./s, and a reduction of 70% to form steel wire with a diameter of 5.2 mm.

Following the hot rolling, water-cooling to 800° C. was performed, and then controlled cooling was carried out so as to complete the transformation into pearlite.

The resulting pearlite steel wire was then subjected to conventional cold wire drawing to form a filament which was used as cord wire for the manufacture of automobile tires. The resulting filament had a maximum tensile strength of 408 kgf/mm$^2$, a torsion strength of 25 cycles, and a bending fracture probability of 4.0%.

EXAMPLE 9

Steel bars of carbon steel (0.53% C-0.28% Si-0.79% Mn) were heated to 950° C. and hot rolled to a diameter of 22.5 mm at a temperature of 780° C. using an 8 stand tandem mill. After hot-rolling the resulting wire was air-cooled to 500° C., and then rapidly heated to 700° C. by high-frequency heating. After heating to 700° C. the steel wire was hot-rolled to a diameter of 15.0 mm using the tandem mill with a reduction of 56%. The temperature of the wire at the outlet of the mill was 890° C. After rolling, the wire was quenched in 0.6 seconds. The wire was then reheated to 690° C. by high-frequency heating, and then high speed rolling with the tandem mill was carried out to roll the wire to a diameter of 7.4 mm with a reduction of 76%. The roll finishing temperature was 880° C., and after water-cooling a PC steel bar with a diameter of 7.4 mm was obtained.

The resulting PC steel bar had a tensile strength of 155.0 kgf/mm$^2$, a yield strength of 142.7 kgf/mm$^2$, an elongation of 14.6%, a uniform elongation of 10.3%, a relaxation value at 180° C. of 6.0%, and an impact fracture energy of 7.26 kgf-mm/mm³.

TABLE 1

| Steel | Chemical Composition (wt %) | | | | | | | | | | | | | | |
|---|---|---|---|---|---|---|---|---|---|---|---|---|---|---|---|
| | C | Si | Mn | P | S | Cr | Mo | V | Nb | Ti | Al | N | Ni | Co | Fe + Impurities |
| A | 0.004 | 0.009 | 0.021 | 0.004 | 0.004 | 0.016 | — | 0.001 | 0.001 | 0.001 | 0.002 | 0.0027 | — | — | Bal. |
| B | 0.08 | 0.73 | 1.61 | 0.015 | 0.002 | 0.01 | — | 0.002 | 0.003 | 0.123 | 0.006 | 0.0099 | — | — | " |
| C | 0.18 | 0.20 | 0.43 | 0.023 | 0.019 | 0.05 | — | 0.001 | 0.001 | 0.002 | 0.037 | 0.0085 | — | — | " |
| D | 0.44 | 0.26 | 0.77 | 0.019 | 0.019 | 0.06 | — | 0.001 | 0.001 | 0.001 | 0.049 | 0.0078 | — | — | " |
| E | 0.11 | 0.28 | 1.42 | 0.016 | 0.003 | 0.03 | — | 0.051 | 0.042 | 0.023 | 0.025 | 0.0054 | — | — | " |
| F | 0.09 | 0.19 | 1.36 | 0.010 | 0.002 | 0.01 | — | 0.004 | 0.002 | 0.090 | 0.037 | 0.0073 | — | — | " |
| G | 0.27 | 0.32 | 0.51 | 0.009 | 0.003 | 1.02 | 0.36 | 0.009 | 0.033 | 0.012 | 0.046 | 0.0109 | — | — | " |
| H | 0.89 | 0.31 | 0.44 | 0.018 | 0.010 | 0.02 | — | 0.002 | 0.001 | 0.002 | 0.033 | 0.0095 | — | — | " |
| I | 0.36 | 1.01 | 0.43 | 0.017 | 0.011 | 5.16 | 0.77 | 0.49 | 0.006 | 0.006 | 0.066 | 0.0137 | — | — | " |
| J | 0.82 | 0.25 | 0.35 | 0.021 | 0.018 | 4.29 | 4.81 | 2.03 | 0.010 | 0.032 | 0.058 | 0.0129 | — | — | " |
| K | 0.007 | 0.01 | 0.01 | 0.001 | 0.001 | 0.03 | 6.03 | — | — | 1.20 | 0.060 | 0.0022 | 17.2 | 12.6 | " |

TABLE 2

| Run No. | | Steel | Heating Temp. (°C.) | Microstructure Before Rolling | Initial Temp. (°C.) | Finishing Temp. (°C.) | Reduction (%) | Retaining Time (sec) | Cooling | Grain Size (μm) Austenite | Grain Size (μm) Ferrite |
|---|---|---|---|---|---|---|---|---|---|---|---|
| This Invention | 1-1 | A | 710 | F | 710 | 910 | 63 | 0 | Air-Cooling | — | 5.6 |
| | 1-2 | | | | | | | 5 | Water-Cooling | 5.8* | 3.4 |
| | 1-3 | B | | F + C | | | | 0 | Air-Cooling | — | 5.9 |
| | 1-4 | | | | | | | 5 | Water-Cooling | 6.7* | 3.8 |
| | 1-5 | C | | F + P | | | | 0 | Air-Cooling | — | 4.4 |
| | 1-6 | | | | | | | 5 | Water-Cooling | 6.3 | — |
| | 1-7 | D | | | | | | 0 | Air-Cooling | — | 5.6 |
| | 1-8 | | | | | | | 5 | Water-Cooling | 6.0 | — |
| | 1-9 | E | | | | | | 0 | Air-Cooling | — | 4.1 |
| | 1-10 | | | | | | | 5 | Water-Cooling | 5.1 | — |
| | 1-11 | F | | | | | | 0 | Air-Cooling | — | 4.0 |
| | 1-12 | | | | | | | 5 | Water-Cooling | 4.6 | — |
| | 1-13 | G | | | | | | 0 | Air-Cooling | — | 3.9 |
| | 1-14 | | | | | | | 5 | Water-Cooling | 4.8 | — |
| | 1-15 | H | | P + C | | | | 0 | Air-Cooling | 7.2* | ** |
| | 1-16 | | | | | | | 5 | Water-Cooling | 7.1 | ** |
| | 1-17 | I | 750 | F + SC | 750 | 920 | | 0 | Air-Cooling | 6.9 | 1.9 |
| | 1-18 | | | | | | | 5 | Water-Cooling | 6.2 | — |
| | 1-19 | J | 800 | | 800 | 980 | | 0 | Air-Cooling | 6.6 | — |
| | 1-20 | | | | | | | 5 | Water-Cooling | 5.0 | — |
| | 1-21 | K | 675 | F + MC | 675 | 850 | | 0 | Air-Cooling | 3.7 | — |
| | 1-22 | | | | | | | 5 | Water-Cooling | 3.9 | — |
| Conventional | 1-23 | A | 950 | A | 850 | 825 | | 0 | Air-Cooling | 24.7* | 13.1 |
| | 1-24 | | | | | | | 5 | 650° C. Rapid Cooling → Air Cooling | 20.2* | 10.2 |
| | 1-25 | E | | | | | | 0 | Air-Cooling | 23.7 | 12.5 |
| | 1-26 | | | | | | | 5 | 650° C. Rapid Cooling → Air Cooling | 20.5 | — |

NOTE
(1) A: Austenite. F: Ferrite. C: Carbide MC: Intermetallic Compound SC: Spherical Carbide P: Pearlite
(2) "*" Estimated on the basis of a primary ferritic structure.
(3) "—" Not determined.
(4) "**" Not determined because a pearlite structure was formed.

TABLE 3

| Run No. | | Steel | Heating Temp. (°C.) | Microstructure Before Rolling | Initial Temp. (°C.) | Finishing Temp. (°C.) | Reduction Before Rolling | Reduction After Rolling | Reduction (%) | Retaining Time at 905° C. (sec) | Cooling | Grain Size (μm) Austenite | Grain Size (μm) Ferrite | Remarks |
|---|---|---|---|---|---|---|---|---|---|---|---|---|---|---|
| This Invention | 2-1 | G | 700 | F + P | 700 | 790 | 10 mm | 7.5 mm | 25% | 0 | A | — | 9.6 | NOTE |
| | 2-2 | | | | | | | | | 5 | W | 20.6 | — | (2) |
| | 2-3 | | | | | 840 | 12 mm | | 38% | 0 | A | — | 4.4 | |
| | 2-4 | | | | | | | | | 5 | W | 4.9 | — | |
| | 2-5 | | | | | 905 | 15 mm | | 50% | 0 | A | — | 3.8 | NOTE |
| | 2-6 | | | | | | | | | 5 | W | 4.7 | — | (3) |
| | 2-7 | | | | | | 20 mm | | 63% | 0 | A | — | 3.6 | |
| | 2-8 | | | | | | | | | 5 | W | 3.9 | — | |
| | 2-9 | | | | | | 25 mm | 5 mm | 80% | 0 | A | — | 3.1 | NOTE |

TABLE 3-continued

| Run No. | Steel | Heating Temp. (°C.) | Microstructure Before Rolling | Initial Temp. (°C.) | Finishing Temp. (°C.) | Reduction Before Rolling | Reduction After Rolling | Reduction (%) | Retaining Time at 905° C. (sec) | Cooling | Grain Size (μm) Austenite | Grain Size (μm) Ferrite | Remarks |
|---|---|---|---|---|---|---|---|---|---|---|---|---|---|
| 2-10 | | | | | | | | | 5 | W | 3.8 | — | (4) |

NOTE:
(1) W: Water-Cooling. A: Air-Cooling
(2) Rapidly heated to 905° C. with an induction heating coil disposed at the outlet of the mill and then cooled.
(3) Heated to 905° C. due to the heat generated during rolling with a planetary mill and then cooled.
(4) Rolled in 4 passes, and heated by 50° C. after each pass with an induction heating coil.

TABLE 4

| | Run No. | Steel | Heating Temp. (°C.) | Microstructure Before Rolling | Initial Temp. (°C.) | Reduction (%) | Finishing Temp. (°C.) | Retaining Time | Cooling | Microstructure After Cooling | Microstructure Before Cooling: % Area of Austenite | Austenite Grain Size | Ferrite Grain Size |
|---|---|---|---|---|---|---|---|---|---|---|---|---|---|
| Comparative | 3-1 | A | 710 | F | 650 | 63 | 756 | 0 sec | Water-Cooling | F | 0% | — | 57.7 μm |
| | 3-2 | | | | | | 752 | 1 min | | | 0% | — | 49.3 μm |
| | 3-3 | | | | 710 | | 804 | 0 sec | | | 0% | — | 58.5 μm |
| | 3-4 | | | | | | 807 | 1 min | | | 0% | — | 50.2 μm |
| | 3-5 | | | | | | 823 | 0 sec | | | 0% | — | 30.6 μm |
| | 3-6 | | | | | | 821 | 1 min | | | 0% | — | 23.5 μm |
| This Invention | 3-7 | | | | | | 880 | 0 sec | | | 100% | — | 4.1 μm |
| | 3-8 | | | | | | 877 | 1 min | | | 100% | — | 4.8 μm |
| | 3-9 | | | | | | 915 | 0 sec | | | 100% | — | 3.5 μm |
| | 3-10 | | | | | | 918 | 1 min | | | 100% | — | 4.9 μm |
| Comparative | 3-11 | G | | F + P + B | 650 | | 717 | 0 sec | | F + P | 0% | — | 43.7 μm |
| | 3-12 | | | | | | 710 | 1 min | | | 0% | — | 40.8 μm |
| This Invention | 3-13 | | | | 710 | | 745 | 0 sec | | F + M + C | 18% | 1.5 μm | 13.6 μm |
| | 3-14 | | | | | | 739 | 1 min | | | 43% | 2.9 μm | 11.5 μm |
| | 3-15 | | | | | | 792 | 0 sec | | F + M + C | 34% | 2.0 μm | 9.3 μm |
| | 3-16 | | | | | | 777 | 1 min | | | 80% | 3.3 μm | 3.2 μm |
| | 3-17 | | | | | | 815 | 0 sec | | F + M | 55% | 1.7 μm | 4.9 μm |
| | 3-18 | | | | | | 825 | 1 min | | M | 100% | 2.8 μm | — |
| | 3-19 | | | | | | 880 | 0 sec | | | 80% | 2.5 μm | 3.7 μm |
| | 3-20 | | | | | | 874 | 1 min | | | 100% | 3.1 μm | — |
| | 3-21 | | | | | | 916 | 0 sec | | | 100% | 3.0 μm | — |
| | 3-22 | | | | | | 903 | 1 min | | | 100% | 4.9 μm | — |
| | 3-23 | | | M | | | 740 | 0 sec | | F + M + C | 21% | 1.0 μm | 9.6 μm |
| | 3-24 | | | | | | 826 | | | F + M | 64% | 2.2 μm | 4.3 μm |
| | 3-25 | | | | | | 900 | | | M | 100% | 3.9 μm | — |

NOTE:
B: Bainite M: Martensite

TABLE 5

| | Run No. | Steel | Heating Temp. (°C.) | Microstructure Before Rolling: Type | Microstructure Before Rolling: % Area of Ferrite | Initial Temp. (°C.) | Reduction (%) | Finishing Temp. (°C.) | Retaining Time |
|---|---|---|---|---|---|---|---|---|---|
| This Invention | 4-1 | D | 740 | F + A | 86% | 730 | 63 | 810 | 0 sec |
| | 4-2 | | | | | | | 815 | |
| | 4-3 | | | | | | | 810 | |
| | 4-4 | | | | | | | 813 | |
| | 4-5 | | 780 | | 40% | 750 | | 808 | |
| | 4-6 | | | | | | | 805 | |
| | 4-7 | | | | | | | 810 | 1 min |
| | 4-8 | | | | | | | 810 | |
| Comparative | 4-9 | | 850 | A | 0% | 800 | | 820 | 0 sec |
| | 4-10 | | | | | | | 820 | |
| | 4-11 | | | | | | | 817 | 1 min |
| | 4-12 | | | | | | | 815 | |

| | Run No. | Cooling | Microstructure After Cooling: Type | Microstructure After Cooling: Ferrite Grain Size | Microstructure Before Cooling: % Area of Austenite | Austenite Grain Size | Ferrite Grain Size |
|---|---|---|---|---|---|---|---|
| This Invention | 4-1 | W | F + M | 10.3 μm | 42% | 1.5 μm | 10.5 μm |
| | 4-2 | A | F + P | 4.1 μm | 97% | 2.9 μm | 8.3 μm |
| | 4-3 | W | F + M | 9.8 μm | 44% | 1.3 μm | 9.8 μm |
| | 4-4 | A | F + P | 2.7 μm | 89% | 3.1 μm | 8.5 μm |
| | 4-5 | W | F + M | 6.6 μm | 86% | 2.0 μm | 8.2 μm |
| | 4-6 | A | F + P | 7.3 μm | 94% | 3.7 μm | 9.5 μm |
| | 4-7 | W | F + M | 3.0 μm | 80% | 2.2 μm | 9.6 μm |
| | 4-8 | A | F + P | 2.2 μm | 100% | 2.3 μm | — |
| Comparative | 4-9 | W | M | — | | 78.5 μm | — |
| | 4-10 | A | F + P | 37.2 μm | | 29.5 μm | — |

TABLE 5-continued

| | | | | | | |
|---|---|---|---|---|---|---|
| | 4-11 | W | M | — | 98.4 μm | — |
| | 4-12 | A | F + P | 21.8 μm | 30.6 μm | — |

TABLE 6

| Run No. | | Steel | Heating Temp. (°C.) | Microstructure Before Rolling Type | Microstructure Before Rolling % Area of Ferrite | Initial Temp. (°C.) | Reduction (%) | Finishing Temp. (°C.) | Retaining Time |
|---|---|---|---|---|---|---|---|---|---|
| Comparative | 5-1 | G | 875 | A | 0% | 700 | 63 | 844 | 0 sec |
| | 5-2 | | | | | | | 852 | |
| | 5-3 | | | | | 675 | | 845 | |
| | 5-4 | | | | | | | 847 | |
| This Invention | 5-5 | | | A + F | 26% | 625 | | 840 | |
| | 5-6 | | | | 30% | | | 845 | |
| | 5-7 | | | | 73% | 600 | | 857 | |
| | 5-8 | | | | 76% | | | 859 | |
| | 5-9 | | | F | 100% | 575 | | 810 | |
| | 5-10 | | | | | | | 810 | |
| | 5-11 | | 700 | B | | 700 | | 848 | |
| | 5-12 | | | Tempered M | | | | 845 | |

| Run No. | | Cooling | Microstructure After Cooling Type | Microstructure After Cooling Ferrite Grain Size | Microstructure Before Cooling % Area of Austenite | Microstructure Before Cooling Austenite Grain Size | Microstructure Before Cooling Ferrite Grain Size |
|---|---|---|---|---|---|---|---|
| Comparative | 5-1 | W | M | — | 100% | Coarse Elongated Grains | — |
| | 5-2 | A | B | — | 100% | Coarse Elongated Grains | — |
| | 5-3 | W | M | — | 100% | Coarse Elongated Grains | — |
| | 5-4 | A | B | — | 100% | Coarse Elongated Grains | — |
| This Invention | 5-5 | W | F + M | 1.9 μm | 100% | 10–15 μm grains + | — |
| | 5-6 | A | F + B | 2.5 μm | 100% | 2 μm grains | — |
| | 5-7 | W | F + M | 2.5 μm | 100% | 4.2 μm | — |
| | 5-8 | A | F + B | 2.8 μm | 100% | 3.9 μm | — |
| | 5-9 | W | B + M | — | 100% | 2.9 μm | — |
| | 5-10 | A | F | 2.4 μm | 100% | 3.1 μm | — |
| | 5-11 | A | F | 2.2 μm | 100% | 3.0 μm | — |
| | 5-12 | A | F | 1.8 μm | 100% | 2.7 μm | — |

TABLE 7

| Run No. | | Steel | * | Microstructure Before Rolling Type | Microstructure Before Rolling % Area of Ferrite | Microstructure Before Rolling % Area of Pearlite | Initial Temp. (°C.) | Reduction (Planetary mill) (%) |
|---|---|---|---|---|---|---|---|---|
| Comparative | 6-1 | 1 | 5 min | A + CN | 0% | 0% | 700 | 63 |
| | 6-2 | | 10 min | A + CN + P | 0% | 10% | | |
| This Invention | 6-3 | | 20 min | A + CN + P | 0% | 45% | | |
| | 6-4 | | 1 hr | A + F + P + CN | 13% | 59% | | |
| | 6-5 | | 2 hr | F + P + CN | 28% | 72% | | |

| Run No. | | Finishing Temp. (°C.) | Retaining Time After Rolling | Cooling | Microstructure After Cooling Type | Microstructure After Cooling Ferrite Grain Size | Microstructure Before Cooling % Area of Austenite | Microstructure Before Cooling Austenite Grain Size | Microstructure Before Cooling Ferrite Grain Size |
|---|---|---|---|---|---|---|---|---|---|
| Comparative | 6-1 | 906 | 0 sec | Air-Cooling | M | — | 100% | 27.4 μm | — |
| | 6-2 | 910 | | | M | — | 100% | 21.6 μm | — |
| This Invention | 6-3 | 935 | | | M | — | 100% | 13.5 μm | — |
| | 6-4 | 928 | | | M | — | 100% | 2.8 μm | — |
| | 6-5 | 930 | | | M | — | 100% | 2.6 μm | — |

NOTE
(1) CN: Carbo-, nitrides
(2) *: Retaining Time at 700° C. after Hot-Forging

TABLE 8

| Run No. | | Steel | Heating Temp. (°C.) | Microstructure Before Rolling | Initial Temp. (°C.) | Finishing Temp. (°C.) | Reduction (%) | Retaining Time | Cooling | Microstructure Before Cooling % Area of Austenite | Microstructure Before Cooling Austenite Grain Size | Microstructure Before Cooling Ferrite Grain Size |
|---|---|---|---|---|---|---|---|---|---|---|---|---|
| This Invention | 7-1 | A | 710 | F | 710 | 920 | 63 | 0 sec | Water-Cooling | 96% | 3.7 μm | 5.8 μm |
| | 7-2 | | | | | | | 2 sec | | 97% | 5.9 μm | 3.9 μm |
| | 7-3 | | | | | | | 5 sec | | 98% | 5.3 μm | — |
| | 7-4 | B | | F + CN | | | | 0 sec | | 93% | 2.1 μm | 5.3 μm |
| | 7-5 | | | | | | | 2 sec | | 94% | 5.0 μm | 3.2 μm |

TABLE 8-continued

| Run No. | Steel | Heating Temp. (°C.) | Microstructure Before Rolling | Initial Temp. (°C.) | Finishing Temp. (°C.) | Reduction (%) | Retaining Time | Cooling | Microstructure Before Cooling: % Area of Austenite | Austenite Grain Size | Ferrite Grain Size |
|---|---|---|---|---|---|---|---|---|---|---|---|
| 7-6 | | | | | | | 5 sec | | 92% | 6.7 μm | 3.8 μm |
| 7-7 | C | | F + P | | | | 0 sec | | 85% | 2.8 μm | 5.7 μm |
| 7-8 | | | | | | | 5 sec | | 89% | 6.3 μm | 4.4 μm |
| 7-9 | | | | | | | 15 sec | | 92% | 5.2 μm | 3.6 μm |
| 7-10 | | | | | | | 30 sec | | 100% | 5.6 μm | — |
| 7-11 | D | | | | | | 0 sec | | 95% | 2.0 μm | 5.0 μm |
| 7-12 | | | | | | | 5 sec | | 92% | 6.0 μm | 3.4 μm |
| 7-13 | | | | | | | 15 sec | | 97% | 6.7 μm | 2.6 μm |
| 7-14 | | | | | | | 30 sec | | 100% | 7.0 μm | — |
| 7-15 | E | | | | | | 0 sec | | 95% | 5.1 μm | 3.6 μm |
| 7-16 | | | | | | | 30 sec | | 94% | 4.7 μm | 3.2 μm |
| 7-17 | | | | | | | 1 min | | 95% | 6.6 μm | 2.7 μm |
| 7-18 | | | | | | | 2 min | | 100% | 6.9 μm | — |
| 7-19 | F | | | | | | 0 sec | | 92% | 4.6 μm | 3.0 μm |
| 7-20 | | | | | | | 30 sec | | 93% | 2.8 μm | 2.1 μm |
| 7-21 | | | | | | | 1 min | | 100% | 8.2 μm | — |
| 7-22 | | | | | | | 2 min | | 100% | 8.0 μm | — |
| 7-23 | G | | | | | | 0 sec | | 98% | 4.8 μm | 9.9 μm |
| 7-24 | | | | | | | 30 sec | | 97% | 3.0 μm | 3.8 μm |
| 7-25 | | | | | | | 1 min | | 100% | 8.0 μm | — |
| 7-26 | | | | | | | 2 min | | 100% | 9.6 μm | — |
| 7-27 | H | | P + CN | | | | 0 sec | | 93% | 2.9 μm | 6.9 μm |
| 7-28 | | | | | | | 5 sec | | 96% | 7.1 μm | 4.8 μm |
| 7-29 | | | | | | | 15 sec | | 100% | 6.6 μm | — |
| 7-30 | | | | | | | 30 sec | | 100% | 6.3 μm | — |
| 7-31 | I | 800 | F + SC | | | | 0 sec | | 12% | 2.6 μm | 13.5 μm |
| 7-32 | | | | | | | 1 min | | 95% | 4.0 μm | 4.7 μm |
| 7-33 | | | | | | | 5 min | | 93% | 6.4 μm | 4.0 μm |
| 7-34 | | | | | | | 30 min | | 100% | 5.9 μm | — |
| 7-35 | | | | | | | 1 hr | | 100% | 11.7 μm | — |
| 7-36 | J | 800 | F + SC | 800 | 1010 | | 0 sec | | 15% | 2.0 μm | 28.7 μm |
| 7-37 | | | | | | | 1 min | | 77% | 2.8 μm | 10.0 μm |
| 7-38 | | | | | | | 5 min | | 84% | 3.1 μm | 4.6 μm |
| 7-39 | | | | | | | 30 min | | 86% | 5.5 μm | 2.8 μm |
| 7-40 | | | | | | | 1 hr | | 100% | 9.3 μm | — |
| 7-41 | K | 675 | F + MC | 675 | 860 | | 0 sec | | 19% | 2.9 μm | 10.6 μm |
| 7-42 | | | | | | | 1 min | | 72% | 4.0 μm | 4.9 μm |
| 7-43 | | | | | | | 5 min | | 96% | 3.7 μm | 4.7 μm |
| 7-44 | | | | | | | 30 min | | 100% | 4.2 μm | — |
| 7-45 | | | | | | | 1 hr | | 100% | 9.1 μm | — |

NOTE
SC: Spheroidal Carbides

TABLE 9

| | Run No. | Steel | Heating Temp. (°C.) | Microstructure Before Rolling | Initial Temp. (°C.) | Finishing Temp. (°C.) | Reduction: Before Rolling | Reduction: After Rolling | Reduction: (%) | Retaining Time at 900° C. | Cooling | Austenite Grain Size: Before Cooling | Ferrite Grain Size: After Cooling | Remarks |
|---|---|---|---|---|---|---|---|---|---|---|---|---|---|---|
| This Invention | 8-1 | G | 700 | F + P | 700 | 790 | 10 mm | 7.5 mm | 25% | 0 sec | A | — | 9.6 μm | 2 |
| | 8-2 | | | | | | | | | 5 sec | W | 20.6 μm | — | |
| | 8-3 | | | | | | | | | 30 sec | | 14.3 μm | — | |
| | 8-4 | | | | | | | | | 1 min | | 15.0 μm | — | |
| | 8-5 | | | | | 840 | 12 mm | | 38% | 1 | A | — | 4.4 μm | 3 |
| | 8-6 | | | | | | | | | 5 sec | W | 4.9 μm | — | |
| | 8-7 | | | | | | | | | 30 sec | | 3.6 μm | — | |
| | 8-8 | | | | | | | | | 1 min | | 4.1 μm | — | |
| | 8-9 | | | | | 845 | 15 mm | | 50% | 1 | A | — | 3.8 μm | |
| | 8-10 | | | | | | | | | 5 sec | W | 4.7 μm | — | |
| | 8-11 | | | | | | | | | 30 sec | | 4.2 μm | — | |
| | 8-12 | | | | | | | | | 1 min | | 3.4 μm | — | |
| | 8-13 | | | | | | 20 mm | | 63% | 1 | A | — | 3.6 μm | |
| | 8-14 | | | | | | | | | 5 sec | W | 4.9 μm | — | |
| | 8-15 | | | | | | | | | 30 sec | | 2.8 μm | — | |
| | 8-16 | | | | | | | | | 1 min | | 3.3 μm | — | |
| | 8-17 | | | | | | 25 mm | 5 mm | 80% | 1 | A | — | 4.1 μm | |
| | 8-18 | | | | | | | | | 5 sec | W | 6.8 μm | — | |
| | 8-19 | | | | | | | | | 30 sec | | 2.4 μm | — | |
| | 8-20 | | | | | | | | | 1 min | | 5.6 μm | — | |

NOTE.
W: Water-Cooling, A: Air-Cooling
1 Immediately After Rolling
2 Rapidly heated to 900° C. with an induction heating coil disposed at the outlet of the mill and then cooled
3 Heated to 845° C. due to the heat generated during rolling with a planetary mill and, further heated to 900° C. by induction heating, retained, then cooled.

TABLE 10

| Run No. | | Steel | Heating Temp. (°C.) | Microstructure Before Rolling | Initial Temp. (°C.) | Reduction (%) | Finishing Temp. (°C.) | Retaining Time | Cooling | Microstructure After Cooling | Microstructure Before Cooling: % Area of Austenite | Austenite Grain Size | Ferrite Grain Size |
|---|---|---|---|---|---|---|---|---|---|---|---|---|---|
| Comparative | 9-1 | A | 710 | F | 650 | 63 | 754 | 5 sec | Water-Cooling | F | 0% | — | 60.3 μm |
| | 9-2 | | | | | | 750 | 1 min | | | 0% | — | 51.4 μm |
| | 9-3 | | | | 710 | | 810 | 5 sec | | | 0% | — | 57.7 μm |
| | 9-4 | | | | | | 806 | 1 min | | | 0% | — | 50.2 μm |
| | 9-5 | | | | | | 825 | 5 sec | | | 0% | — | 52.6 μm |
| | 9-6 | | | | | | 825 | 1 min | | | 0% | — | 33.5 μm |
| This Invention | 9-7 | | | | | | 887 | 5 sec | | | 90~100% | 1.5~2 μm | 3.9 μm |
| | 9-8 | | | | | | 869 | 1 min | | | 90~100% | 1.5~2 μm | 4.8 μm |
| | 9-9 | | | | | | 929 | 5 sec | | | 90~100% | 1.5~2 μm | 3.2 μm |
| | 9-10 | | | | | | 920 | 1 min | | | 90~100% | 1.5~2 μm | 4.9 μm |
| Comparative | 9-11 | G | | F + P + B | 650 | | 715 | 5 sec | | F + P | 0% | — | 45.7 μm |
| | 9-12 | | | | | | 710 | 1 min | | | 0% | — | 48.7 μm |
| This Invention | 9-13 | | | | 710 | | 745 | 5 sec | | F + M + C | 20% | 1.8 μm | 30.6 μm |
| | 9-14 | | | | | | 740 | 1 min | | | 43% | 2.9 μm | 21.5 μm |
| | 9-15 | | | | | | 782 | 5 sec | | | 37% | 2.0 μm | 10.3 μm |
| | 9-16 | | | | | | 790 | 1 min | | | 82% | 3.3 μm | 3.2 μm |
| | 9-17 | | | | | | 810 | 5 sec | | F + M | 60% | 1.4 μm | 6.8 μm |
| | 9-18 | | | | | | 830 | 1 min | | M | 100% | 2.8 μm | — |
| | 9-19 | | | | | | 875 | 5 sec | | | 85% | 2.0 μm | 4.4 μm |
| | 9-20 | | | | | | 880 | 1 min | | | 100% | 3.1 μm | — |
| | 9-21 | | | | | | 923 | 5 sec | | | 100% | 3.2 μm | — |
| | 9-22 | | | | | | 920 | 1 min | | | 100% | 4.9 μm | — |
| | 9-23 | | | M | | | 743 | 5 sec | | F + M + C | 25% | 1.2 μm | 12.1 μm |
| | 9-24 | | | | | | 830 | | | F + M | 65% | 2.3 μm | 4.0 μm |
| | 9-25 | | | | | | 918 | | | M | 100% | 3.7 μm | — |
| Comparative | 9-26 | H | | P | 650 | | 704 | | | | 0% | — | — |
| This Invention | 9-27 | | | | 710 | | 810 | | | | 100% | 3.9 μm | — |

TABLE 11

| Run No. | | Steel | Heating Temp. (°C.) | Microstructure Before Rolling: Type | % Area of Ferrite | Initial Temp. (°C.) | Reduction (%) | Finishing Temp. (°C.) | Retaining Time |
|---|---|---|---|---|---|---|---|---|---|
| This Invention | 10-1 | D | 740 | F + A | 86% | 730 | 63 | 810 | 5 sec |
| | 10-2 | | | | | | | 815 | |
| | 10-3 | | | | | | | 810 | 1 min |
| | 10-4 | | | | | | | 813 | |
| | 10-5 | | 780 | | 40% | 750 | | 808 | 5 sec |
| | 10-6 | | | | | | | 805 | |
| | 10-7 | | | | | | | 810 | 1 min |
| | 10-8 | | | | | | | 810 | |
| Comparative | 10-9 | | 850 | A | 0% | 800 | | 800 | 5 sec |
| | 10-10 | | | | | | | 800 | |
| | 10-11 | | | | | | | 817 | 1 min |
| | 10-12 | | | | | | | 815 | |

| Run No. | | Cooling | Microstructure After Cooling: Type | Ferrite Grain Size | Microstructure Before Cooling: % Area of Austenite | Austenite Grain Size | Ferrite Grain Size |
|---|---|---|---|---|---|---|---|
| This Invention | 10-1 | W | F + M | 10.5 μm | 64% | 1.7 μm | 14.5 μm |
| | 10-2 | A | F + P | 3.8 μm | 95% | 2.6 μm | 7.7 μm |
| | 10-3 | W | F + M | 11.3 μm | 60% | 1.4 μm | 9.6 μm |
| | 10-4 | A | F + P | 2.0 μm | 90% | 3.0 μm | 8.0 μm |
| | 10-5 | W | F + M | 6.0 μm | 90% | 2.1 μm | 8.4 μm |
| | 10-6 | A | F + P | 5.2 μm | 95% | 3.6 μm | 9.2 μm |
| | 10-7 | W | F + M | 2.8 μm | 95% | 2.0 μm | 9.7 μm |
| | 10-8 | A | F + P | 2.2 μm | 100% | 2.1 μm | — |
| Comparative | 10-9 | W | M | — | 100% | 84.5 μm | — |
| | 10-10 | A | F + P | 15.0 μm | 100% | 32.4 μm | — |
| | 10-11 | W | M | — | 100% | 87.6 μm | — |
| | 10-12 | A | F + P | 14.1 μm | 100% | 33.0 μm | — |

NOTE
W: Water-Cooling, A: Air-Cooling

TABLE 12

| Run No. | | Steel | Heating Temp. (°C.) | Microstructure Before Rolling: Type | % Area of Ferrite | Initial Temp. (°C.) | Reduction (%) | Finishing Temp. (°C.) | Retaining Time |
|---|---|---|---|---|---|---|---|---|---|
| Comparative | 11-1 | G | 875 | A | 0% | 700 | 63 | 844 | 15 sec |

TABLE 12-continued

| | | | | | | |
|---|---|---|---|---|---|---|
| ative | 11-2 | | | | | 852 |
| | 11-3 | | | | 675 | 845 |
| | 11-4 | | | | | 847 |
| This | 11-5 | | A + F | 4% | 650 | 855 |
| Invention | 11-6 | | | 7% | | 850 |
| | 11-7 | | | 26% | 625 | 840 |
| | 11-8 | | | 30% | | 845 |
| | 11-9 | | | 73% | 600 | 857 |
| | 11-10 | | | 76% | | 859 |
| | 11-11 | | F | 100% | 575 | 810 |
| | 11-12 | | | | | 810 |
| | 11-13 | 700 | B | | 700 | 848 |
| | 11-14 | | Tempered M | | | 845 |

| | | | Microstructure After Cooling | | Microstructure Before Cooling | | |
|---|---|---|---|---|---|---|---|
| Run No. | | Cooling | Type | Ferrite Grain Size | % Area of Austenite | Austenite Grain Size | Ferrite Grain Size |
| Compar- | 11-1 | W | M | — | 100% | Coarse Elongated Grains | — |
| ative | 11-2 | A | B | — | 100% | Coarse Elongated Grains | — |
| | 11-3 | W | M | — | 100% | Coarse Elongated Grains | — |
| | 11-4 | A | B | — | 100% | | — |
| This | 11-5 | W | F + M | 2.1 μm | 100% | Coarse grains + | — |
| Invention | 11-6 | A | F + B | 2.2 μm | 100% | Fine grains (2.5 μm) | |
| | 11-7 | W | F + M | 1.9 μm | 100% | 10–12 μm grains + | — |
| | 11-8 | A | F + B | 2.3 μm | 100% | 2 μm grains | — |
| | 11-9 | W | F + M | 2.6 μm | 100% | 4.0 μm | — |
| | 11-10 | A | F + B | 2.9 μm | 100% | 3.8 μm | — |
| | 11-11 | W | B + M | — | 100% | 3.0 μm | — |
| | 11-12 | A | F | 2.3 μm | 100% | 3.1 μm | — |
| | 11-13 | A | F | 2.0 μm | 100% | 2.9 μm | — |
| | 11-14 | A | F | 2.0 μm | 100% | 2.6 μm | — |

TABLE 13

| | | | | Microstructure Before Rolling | | | Initial | Reduction |
|---|---|---|---|---|---|---|---|---|
| Run No. | | Steel * | | Type | % Area of Ferrite | % Area of Pearlite | Temp. (°C.) | (Planetary mill) (%) |
| Compar- | 12-1 | 1 | 5 min | A + C | 0% | 0% | 700 | 63 |
| ative | 12-2 | | 10 min | A + C + P | 0% | 10% | | |
| This | 12-3 | | 20 min | A + C + P | 0% | 45% | | |
| Invention | 12-4 | | 1 hr | A + F + P + C | 13% | 59% | | |
| | 12-5 | | 2 hr | F + P + C | 28% | 72% | | |

| | | | | | Microstructure After Cooling | | Microstructure Before Cooling | | |
|---|---|---|---|---|---|---|---|---|---|
| Run No. | | Finishing Temp. (°C.) | Retaining Time After Rolling | Cooling | Type | Ferrite Grain Size | % Area of Austenite | Austenite Grain Size | Ferrite Grain Size |
| Compar- | 12-1 | 906 | 15 sec | Air- | M | — | 100% | 32.4 μm | — |
| ative | 12-2 | 930 | | Cooling | M | — | 100% | 20.2 μm | — |
| This | 12-3 | 955 | | | M | — | 100% | 7.1 μm | — |
| Invention | 12-4 | 948 | | | M | — | 100% | 2.5 μm | — |
| | 12-5 | 950 | | | M | — | 100% | 2.4 μm | — |

NOTE
*: Retaining Time at 700° C. after Hot-Forging

TABLE 14

| Sample | Alloy Composition | Alloy System |
|---|---|---|
| A | Pure Ti | — |
| B | Ti-5% Al | α-system |
| C | Ti-5% Al-0.01% Y | α-system |

TABLE 14-continued

| Sample | Alloy Composition | Alloy System |
|---|---|---|
| D | Ti-8% Mn | α + β system |
| E | Ti-8% Mn-0.01% Y | α + β system |

TABLE 15

| | | | Rolling and Processing Conditions | | | | | | |
|---|---|---|---|---|---|---|---|---|---|
| Run No. | | Alloy | Heating Temp. (°C.) | Structure Before Rolling | Rolling | Temp. After Rolling | Retaining Time After Rolling | Cooling | Average β-Grain Size After Cooling (μm) |
| This | 1 | A | 650 | α | Severe Rolling | 950 | 10 sec | Water-Cooling | 25 |
| Invention | 2 | | | Single- | with Planetary Mill | | 100 sec | | 73 |
| | 3 | | | phase | | | 0 sec | | Mixture with unchanged α grains |
| | 4 | | | | | | 1 hr | | 430 |

TABLE 15-continued

| Run No. | Alloy | Rolling and Processing Conditions: Heating Temp. (°C.) | Structure Before Rolling | Rolling | Temp. After Rolling | Retaining Time After Rolling | Cooling | Average β-Grain Size After Cooling (μm) |
|---|---|---|---|---|---|---|---|---|
| 5 | | 950 | | 3 Pass Rolling with Conventional Mill | — | 0 sec | | 160 |
| 6 | B | 750 | α | Severe Rolling | 1050 | 10 sec | | 25 |
| 7 | | | Single- | with Planetary Mill | | 100 sec | | 74 |
| 8 | | | phase | | | 0 sec | | Mixture with unchanged α grains |
| 9 | | | | | | 1 hr | | 460 |
| 10 | | 1050 | | 3 Pass Rolling with Conventional Mill | — | 0 sec | | 180 |
| 11 | C | 750 | α | Severe Rolling | 1050 | 10 sec | | 15 |
| 12 | | | Single- | with Planetary Mill | | 100 sec | | 63 |
| 13 | | | phase | | | 0 sec | | Mixture with unchanged α grains |
| 14 | | | | | | 1 hr | | 390 |
| 15 | | 1050 | | 3 Pass Rolling with Conventional Mill | — | 0 sec | | 130 |
| 16 | D | 630 | α + β | Severe Rolling | 930 | 10 sec | | 25 |
| 17 | | | Dual-phase | with Planetary Mill | | 100 sec | | 70 |
| 18 | | | | | | 0 sec | | Mixture with unchanged α grains |
| 19 | | | | | | 1 hr | | 380 |
| 20 | | 930 | | 3 Pass Rolling with Conventional Mill | — | 0 sec | | 140 |
| 21 | E | 630 | α + β | Severe Rolling | 930 | 10 sec | | 20 |
| 22 | | | Dual-phase | with Planetary Mill | | 100 sec | | 75 |
| 23 | | | | | | 0 sec | | Mixture with unchanged α grains |
| 24 | | | | | | 1 hr | | 380 |
| 25 | | 930 | | 3 Pass Rolling with Conventional Mill | — | 0 sec | | 120 |

TABLE 16

| Run No. | Alloy | Reduction (%) | Average β-Grain Size after Cooling (μm) |
|---|---|---|---|
| This Invention | C | 20 | 97 |
| | | 30 | 76 |

TABLE 16-continued

| Run No. | Alloy | Reduction (%) | Average β-Grain Size after Cooling (μm) |
|---|---|---|---|
| | | 40 | 62 |
| | | 50 | 40 |

TABLE 17

| Steel | Chemical Composition (% by weight): C | Si | Mn | P | S | Cr | Ni | Mo | V | Nb | Ti | Al | N | Fe + Impurities |
|---|---|---|---|---|---|---|---|---|---|---|---|---|---|---|
| A | 0.001 | 0.008 | 0.020 | 0.002 | 0.001 | 0.007 | 0.001 | 0.001 | 0.001 | 0.001 | 0.001 | 0.0026 | 0.0021 | Bal. |
| B | 0.11 | 0.28 | 1.42 | 0.016 | 0.003 | 0.03 | 0.01 | 0.01 | 0.051 | 0.042 | 0.023 | 0.025 | 0.0054 | " |
| C | 0.93 | 0.22 | 0.76 | 0.016 | 0.010 | 1.22 | 0.02 | 0.01 | 0.055 | 0.001 | 0.001 | 0.034 | 0.0077 | " |
| D | 0.56 | 2.37 | 0.54 | 0.015 | 0.009 | 0.02 | 0.02 | 0.01 | 0.31 | 0.001 | 0.001 | 0.027 | 0.0083 | " |
| E | 0.02 | 0.54 | 0.33 | 0.011 | 0.008 | 16.9 | 0.51 | 1.03 | 0.001 | 0.001 | 0.14 | 0.010 | 0.0153 | " |

TABLE 18

| Run No. | Steel | Processing Conditions | Microstructure After Processing: Ferrite (%) | Average Grain Diameter of Equiaxed Ferrite (μm) | Mechanical Properties: Yield Strength (kgf/mm²) | Tensile Strength (kgf/mm²) | Elongation (%) | Drawing (%) | Weight Loss in Brine (mm/year) |
|---|---|---|---|---|---|---|---|---|---|
| This Invention | 6 | Heating to 950° C.→890°C.: 75% Reduction→Air-Cooling to 600° C.→Rising to 850° C.→90% Reduction: Finishing at 960° C.→Water-Cooling | 100 | 2.0 | 48.5 | 50.8 | 41.0 | 93.0 | — |
| | 7 | A Heating to 950° C.→890° C.: 75% Reduction→Air-Cooling to 600° C.→Rising to 850° C.→90% Reduction: Finishing at 960° C.→Water-Cooling→Heating to 850° C.→86.8% Reduction: Finishing at 950° C.→Water-Cooling | 100 | 0.99 | 54.7 | 65.3 | 47.0 | 95.0 | — |
| | 8 | B Heating to 850° C.→780° C.: 75% Reduction→Air-Cooling to 600° C.→Rising to 700° C.→90% Reduction: Finishing at | 89 | 0.47 | 74.6 | 79.4 | 27.4 | 72.0 | 0.0096 |

TABLE 18-continued

| Run No. | Steel | Processing Conditions | Microstructure After Processing: Ferrite (%) | Average Grain Diameter of Equiaxed Ferrite (μm) | Mechanical Properties: Yield Strength (kgf/mm²) | Tensile Strength (kgf/mm²) | Elongation (%) | Drawing (%) | Weight Loss in Brine (mm/year) |
|---|---|---|---|---|---|---|---|---|---|
| | | 920° C.→Air-Cooling | | | | | | | |
| 9 | B | Heating to 850° C.→780° C.: 75% Reduction→Air-Cooling to 600° C.→Rising to 700° C.→90% Reduction: Finishing at 920° C.→Water-Cooling→Rising to 700° C.→90% Reduction: Finishing at 900° C.→Mist-Cooling | 100 | 0.18 | 81.4 | 85.2 | 33.0 | 80.5 | 0.0039 |
| 10 | C | Heating to 850° C.→780° C.: 75% Reduction→Air-Cooling to 600° C.→Rising to 700° C.→90% Reduction: Finishing at 920° C.→Air-Blowing Cooling to Room Temp.→Rising to 700° C.→90% Reduction: Finishing at 900° C.→Air-Cooling | 100 | 1.96 | 102.0 | 111.5 | 31.0 | 72.3 | 0.012 |
| 11 | D | Heating to 850° C.→780° C.: 75% Reduction→Air-Cooling to 600° C.→Rising to 700° C.→90% Reduction: Finishing at 920° C.→Air-Blowing Cooling to Room Temp.→Rising to 700° C.→90% Reduction: Finishing at 900° C.→Air-Cooling | 100 | 1.45 | 90.9 | 97.3 | 36.0 | 80.4 | 0.010 |
| 12 | E | Heating to 950° C→890° C.: 75% Reduction→Cooling (furnace) to 600° C.→Rising to 750° C.→90% Reduction: Finishing at 960° C.→Air-Cooling→Rising to 750° C.→90% Reduction: Finishing at 960° C.→Air-Cooling | 100 | 0.86 | 66.3 | 79.2 | 42.0 | 87.2 | <0.001 |

NOTE
Weight loss for conventional steel (grain size of ferrite 12 μm) was 0.085 mm/year.

TABLE 19

| Steel | Chemical Composition (% by weight): C | Si | Mn | P | S | Ni | Cr | Mo | V | Al | Fe + Impurities |
|---|---|---|---|---|---|---|---|---|---|---|---|
| A | 0.29 | 1.03 | 1.01 | 0.012 | 0.009 | 0.10 | 1.03 | 0.27 | 0.13 | 0.036 | Bal. |
| B | 0.29 | 0.27 | 0.82 | 0.011 | 0.009 | 2.03 | 1.33 | 0.41 | — | 0.033 | " |
| C | 0.51 | 1.02 | 1.02 | 0.010 | 0.010 | 0.21 | 0.03 | — | — | 1.02 | " |
| D | 0.42 | 0.99 | 0.24 | 0.011 | 0.008 | 0.01 | 5.32 | 1.39 | 0.56 | 0.047 | " |
| E | 0.33 | 0.28 | 0.67 | 0.013 | 0.010 | — | 10.54 | — | — | 0.035 | " |

TABLE 20

| Run No. | | Steel | Processing Conditions | Microstructure After Processing: Bainite (%) | (1) (μm) | Grain Size of Original Austenite (μm) | Mechanical Properties: Tensile Strength (kgf/mm²) | Elongation (%) | Drawing (%) | $vE_{20}$ (kg-m/cm¹) | Endurance Limit Ratio | Weight Loss (mm/year) |
|---|---|---|---|---|---|---|---|---|---|---|---|---|
| This Invention | 1 | B | Heating to 700° C.→70% Reduction→Finishing at 905° C.→Natural-Cooling | 90 | 3.67 | 4.03 | 228 | 10.3 | 42.3 | 12.4 | 0.30 | 0.011 |
| | 2 | B | Heating to 700° C.→70% Reduction→Finishing at 905° C.→330° C. Salt bath × 1 hr→Natural-Cooling | 95 | 1.59 | 3.88 | 229 | 16.6 | 44.6 | 17.6 | 0.32 | 0.006 |
| | 3 | B | Heating to 900° C.→750° C., 50% Reduction→400° C. × 30 min (furnace)→Rising to 650° C.→89% Reduction, Finishing at 900° C.→330° C. Salt bath × 1 hr→Natural-Cooling | 95 | 1.04 | 1.79 | 228 | 17.5 | 46.7 | 19.5 | 0.35 | 0.007 |
| | 4 | B | Heating to 650° C.→50% Reduction→Finishing at 850° C.→400° C. × 30 min (furnace)→Rising to 650° C.→89% Reduction, Finishing at 900° C.→330° C. Salt bath × 1 hr→Natural-Cooling | 100 | 0.43 | — | 230 | 18.5 | 48.5 | 21.0 | 0.36 | 0.004 |

TABLE 20-continued

| Run No. | Steel | Processing Conditions | Microstructure After Processing: Bainite (%) | (1) (μm) | Grain Size of Original Austenite (μm) | Mechanical Properties: Tensile Strength (kgf/mm²) | Elongation (%) | Drawing (%) | vE20 (kg-m/cm¹) | Endurance Limit Ratio | Weight Loss (mm/year) |
|---|---|---|---|---|---|---|---|---|---|---|---|
| 5 | B | Heating to 650° C.→50% Reduction→Finishing at 850° C.→Water-Cooling→Rising to 650° C.→89% Reduction, Finishing at 900° C.→330° C. Salt bath × 1 hr→Natural-Cooling | 100 | 0.19 | 0.31 | 231 | 20.4 | 50.0 | 22.3 | 0.38 | 0.002 |
| 6 | A | Heating to 650° C.→50% Reduction→Finishing at 850° C.→Water-Cooling→Rising to 650° C.→89% Reduction, Finishing at 900° C.→330° C. Salt bath × 1 hr→Natural-Cooling | 100 | 0.62 | 1.06 | 201 | 19.6 | 40.0 | 16.8 | 0.51 | — |
| 7 | C | Heating to 650° C.→50% Reduction→Finishing at 850° C.→Water-Cooling→Rising to 650° C.→89% Reduction, Finishing at 900° C.→330° C. Salt bath × 1 hr→Natural-Cooling | 80 | 0.55 | 0.75 | 286 | 15.3 | 40.0 | 11.3 | 0.30 | — |
| 8 | D | Heating to 650° C.→50% Reduction→Finishing at 850° C.→Water-Cooling→Rising to 650° C.→89% Reduction, Finishing at 900° C.→330° C. Salt bath × 1 hr→Natural-Cooling→Tempering at 500° C. × 1 hr→Natural-Cooling | 100 | 0.98 | 1.62 | 252 | 19.6 | 47.7 | 17.6 | 0.35 | — |
| 9 | E | Heating to 700° C.→50% Reduction→Finishing at 850° C.→Natural-Cooling→Rising to 700° C.→89% Reduction, Finishing at 930° C.→Natural-Cooling | 80 | 0.16 | 0.35 | 205 | 26.4 | 62.1 | 15.0 | 0.54 | — |

NOTE
(1) Average Diameter of Packet

TABLE 21

| Steel | Chemical Composition (% by weight): C | Si | Mn | P | S | Ni | Cr | Mo | V | Nb | Ti | Al | Cr | W | Fe + Impurities |
|---|---|---|---|---|---|---|---|---|---|---|---|---|---|---|---|
| A | 0.11 | 0.28 | 1.42 | 0.016 | 0.003 | 0.01 | 0.03 | 0.01 | 0.051 | 0.042 | 0.023 | 0.025 | — | — | Bal. |
| B | 0.39 | 2.06 | 0.43 | 0.014 | 0.007 | 0.03 | 0.12 | 0.16 | 0.22 | 0.01 | 0.01 | 0.033 | 1.76 | — | " |
| C | 0.40 | 0.23 | 0.66 | 0.010 | 0.008 | 0.01 | 5.02 | 2.11 | 0.43 | 0.01 | 0.01 | 0.021 | — | 1.00 | " |
| D | 0.02 | 0.08 | 0.22 | 0.004 | 0.002 | 19.00 | 0.02 | 5.03 | 0.006 | 0.001 | 0.62 | 0.110 | — | — | " |
| E | 0.04 | 0.44 | 0.20 | 0.007 | 0.005 | 4.2 | 16.7 | — | 0.01 | 0.23 | 0.01 | 0.024 | 3.32 | — | " |

TABLE 22

| Run No. | Steel | Processing Conditions | Microstructure After Processing: Martensite (%) | (1) (μm) | Grain Size of Original Austenite (μm) | Mechanical Properties: Yield Strength (kgf/mm²) | Tensile Strength (kgf/mm) | Elongation (%) | Drawing (%) | Weight Loss (mm/year) |
|---|---|---|---|---|---|---|---|---|---|---|
| Comparative 1 | A | Heating to 980° C.→780° C., 75% Reduction→Water Quenching→Tempering at 650° C. | 100 | 11.3 | 14.7 | 54 | 64 | 37 | 78 | 0.093 |
| This Invention 2 | A | Heating to 700° C.→75% Reduction→Finishing at 915° C.→Water Quenching→Tempering at 650° C. | 100 | 2.29 | 4.84 | 60 | 64 | 34 | 76 | 0.025 |
| 3 | A | Heating to 980° C.→780° C., 75% Reduction→Air-Cooling to 500° C.→Rising to 700° C.→90% Reduction→Finishing at 930° C.→Water Quenching→Tempering at 650° C. | 100 | 1.74 | 1.96 | 62 | 66 | 36 | 76 | 0.0099 |
| 4 | A | Heating to 900° C.→780° C., 75% Reduction→Air-Cooling to 500° C.→Rising to 700° C.→90% Reduction→Finishing at 930° C.→Air-Cooling to Room Temp.→Rising to 700° C.→86.8% Reduction→Finishing at 925° C.→Mist-Cooling→ | 100 | 0.66 | 0.75 | 63 | 68 | 37 | 77 | 0.0085 |

TABLE 22-continued

| Run No. | Steel | Processing Conditions | Microstructure After Processing: Martensite (%) | (1) (μm) | Grain Size of Original Austenite (μm) | Mechanical Properties: Yield Strength (kgf/mm²) | Tensile Strength (kgf/mm) | Elongation (%) | Drawing (%) | Weight Loss (mm/year) |
|---|---|---|---|---|---|---|---|---|---|---|
| | | Tempering at 650° C. | | | | | | | | |
| 5 | A | Heating to 980° C.→780° C., 75% Reduction→Air-Cooling to 500° C.→Rising to 700° C.→90% Reduction→Finishing at 930° C.→Water Quenching→Rising to 700° C.→86.8% Reduction→Finishing at 925° C.→Mist-Cooling→Tempering at 650° C. | 100 | 0.21 | 0.28 | 66 | 70 | 39 | 80 | 0.0051 |
| 6 | B | Heating to 980° C.→780° C., 75% Reduction→Cooling by water shower to 450° C.→Natural-Cooling→Heating to 700° C.→90% Reduction→Finishing at 940° C.→Mist-Cooling→Heating to 700° C.→86.8% Reduction→Finishing at 930° C.→Mist-Cooling→Tempering at 350° C. | 100 | 0.52 | 0.66 | 204.3 | 231.5 | 20.0 | 50.0 | 0.0047 |
| 7 | C | Heating to 980° C.→880° C., 75% Reduction→Cooling by water shower to 500° C.→Natural-Cooling→Heating to 750° C.→90% Reduction→Finishing at 990° C.→Mist-Cooling→Heating to 750° C.→86.8% Reduction→Finishing at 980° C.→Mist-Cooling→Aging at 550° C. | 100 | 0.48 | 0.55 | 200.4 | 247.2 | 12.0 | 47.0 | 0.0028 |
| 8 | D | Heating to 980° C.→830° C., 75% Reduction→Water Quenching→Heating to 700° C.→90% Reduction→Finishing at 990° C.→Mist-Cooling→Heating to 700° C.→86.8% Reduction→Finishing at 980° C.→Mist-Cooling | 80 | 0.19 | 0.27 | 147.5 | 169.5 | 14.0 | 49.3 | <0.001 |
| 9 | D | Heating to 980° C.→830° C., 75% Reduction→Water Quenching→Heating to 700° C.→90% Reduction→Finishing at 990° C.→Mist-Cooling→Heating to 700° C.→86.8% Reduction→Finishing at 980° C.→Mist-Cooling→530° C. × 2 hr. Aging | 87 | 0.20 | 0.34 | 198.0 | 203.4 | 16.6 | 48.7 | <0.001 |
| 10 | E | Heating to 980° C.→830° C., 75% Reduction→Air-Cooling→Heating to 600° C.→90% Reduction→Finishing at 800° C.→Air-Cooling→Heating to 600° C.→86.8% Reduction→Finishing at 800° C.→Air-Cooling→Aging at 500° C. | 100 | 0.18 | — | 211.4 | 232.9 | 14.0 | 50.0 | 0.0036 |

NOTE
(1) Average Diameter of Packet

TABLE 23

| Steel | Chemical Composition (% by weight): C | Si | Mn | P | S | Cr | V | Al | N | $Fe^+$ Impurities |
|---|---|---|---|---|---|---|---|---|---|---|
| A | 0.46 | 0.27 | 0.78 | 0.013 | 0.010 | 0.02 | 0.001 | 0.026 | 0.0083 | Bal. |
| B | 0.79 | 0.33 | 0.56 | 0.006 | 0.003 | 0.02 | 0.001 | 0.010 | 0.0067 | " |
| C | 1.12 | 1.01 | 0.62 | 0.005 | 0.002 | 1.21 | 0.12 | 0.023 | 0.0088 | " |

TABLE 24

| Run No. | Steel | Processing Conditions | Microstructure After Processing: Pearlite (%) | Average Diameter of Pearlite Colony (μm) | Mechanical Properties: Yield Strength (kgf/mm²) | Tensile Strength (kfg/mm) | Drawing (%) | *(1) | Weight Loss (× $10^{-6}$ g/cm) |
|---|---|---|---|---|---|---|---|---|---|
| This Invention 5 | A | Heating to 900° C.→780° C., 75% Reduction→Air-Cooling to 600° C.→Rising to 700° C.→90% Reduction. Finishing Temp. | 63 | 1.10 | 97.7 | 100.0 | 73.0 | 6.3 | 1.77 |

TABLE 24-continued

| Run No. | Steel | Processing Conditions | Microstructure After Processing: Pearlite (%) | Microstructure After Processing: Average Diameter of Pearlite Colony (μm) | Mechanical Properties: Yield Strength (kgf/mm²) | Mechanical Properties: Tensile Strength (kfg/mm) | Mechanical Properties: Drawing (%) | *(1) | Weight Loss (× 10⁻⁶ g/cm) |
|---|---|---|---|---|---|---|---|---|---|
| | | 920° C.→Air-Cooling to Room Temp.→ Rising to 700° C.→86.8% Reduction, Finishing at 915° C.→Mist-Cooling | | | | | | | |
| 6 | B | Heating to 900° C.→780° C., 75% Reduction→Air-Cooling to 600° C.→Rising to 700° C.→90% Reduction, Finishing Temp. 920° C.→Air-Cooling to Room Temp.→ Rising to 700° C.→86.8% Reduction, Finishing at 915° C.→Mist-Cooling | 100 | 1.66 | 114.2 | 127.6 | 55.0 | 5.5 | 0.99 |
| 7 | C | Heating to 900° C.→780° C., 75% Reduction→Air-Cooling to 600° C.→Rising to 700° C.→90% Reduction, Finishing Temp. 920° C.→Air-Cooling to Room Temp.→ Rising to 700° C.→86.8% Reduction, Finishing at 910° C.→Forced Air-Cooling | 100 | 0.95 | 120.5 | 132.5 | 55.0 | 5.3 | 0.56 |

NOTE:
*(1) Ultimate Wire Drawing Ratio = ln ($A_o/A_n$)

[$A_o$: Sectional Area Before Drawing
$A_n$: Sectional Area Before Final Drawing during which the wire broke.]

What is claimed is:

1. A method for producing a metallic material having an ultra-fine microstructure, the metallic material exhibiting a phase transformation of a low-temperature phase into a high-temperature phase, the method comprising the steps of:

preparing a metallic material which comprises at least a low-temperature phase;

applying plastic deformation to the metallic material; and increasing the temperature of the metallic material to a point beyond a transformation point while applying the plastic deformation to effect reverse transformation of the low-temperature phase into a high-temperature phase.

2. A method as set forth in claim 1, wherein the metallic material is selected from the group consisting of steel, titanium, titanium alloys, zirconium, zirconium alloys, nickel, and nickel alloys.

3. A method as set forth in claim 1, further comprising a step of cooling the high-temperature phase to room temperature.

4. A method as set forth in claim 3, wherein the step of cooling is carried out in a manner selected from air-cooling, slow cooling, and rapid cooling.

5. A method as set forth in claim 1, wherein the metallic material is steel, the low-temperature phase is ferrite, and the high-temperature phase is austenite.

6. A method as set forth in claim 1, wherein the metallic material is steel, the low-temperature phase is γ-austenite, and the high-temperature phase is δ-ferrite.

7. A method as set forth in claim 1, further comprising a step of retaining the metallic material at an attained temperature after having increased the temperature to a point higher than the phase transformation point to promote the reverse transformation of the low-temperature phase into the high-temperature phase.

8. A method for producing a steel material having an ultra-fine microstructure comprising the steps of:

preparing a steel material which comprises at least ferrite;

applying plastic deformation to the steel with strains of 20% or more;

increasing the temperature of the steel to a point beyond the $Ac_1$ point while applying the plastic deformation to effect reverse transformation of at least part of the ferrite into austenite; and cooling the steel to room temperature.

9. A method as set forth in claim 8, further comprising a step of retaining the steel material at a temperature higher than the $Ae_1$ point after having increased the temperature to a point higher than the $Ac_1$ point to promote the reverse transformation of ferrite into austenite.

10. A method as set forth in claim 8, wherein the step of cooling is carried out in a manner selected from air-cooling, slow cooling, and rapid cooling.

11. A method as set forth in claim 8, wherein the plastic deformation is carried out by shot blasting.

12. A method for producing a titanium or titanium alloy material having an ultra-fine microstructure comprising the steps of:

preparing a titanium or titanium alloy material which comprises at least α-phase;

applying plastic deformation to the material with strains of 20% or more;

increasing the temperature of the material to a temperature beyond the transformation point into β-phase while applying the plastic deformation;

retaining the material at the attained temperature for no longer than 100 seconds to transform at least a portion of the α-phase into β-phase; and cooling the material to room temperature.

13. A method as set forth in claim 12, wherein the step of cooling is carried out by slow cooling or rapid cooling.

14. A steel material having an ultra-fine microstructure which is obtained in accordance with the method recited in claim 8.

15. A steel material having an ultra-fine microstructure as set forth in claim 14, wherein the steel material is selected from ferritic steels, bainitic steels, martensitic steels, and pearlitic steels.

16. A method as set forth in claim 8, wherein the steel is a high carbon steel wire for use in wire drawing and after transformation into austenite, controlled cooling is performed to promote the transformation of the austenite into pearlite.

17. A method as set forth in claim 8, wherein the steel is a highly-ductile PC steel and the step of carrying out transformation into austenite is performed at least one time, immediately after the transformation step the material is cooled at a cooling rate higher than the critical cooling rate to form a structure comprising martensite in which the average size of a martensitic packet or an original austenitic grain is 5 μm or less, and after the cooling, tempering is carried out at a temperature of $Ac_1$ or lower.

18. A method as set forth in claim 17, wherein the step of tempering is performed while applying plastic deformation with total strains of 3-90%.

19. A method as set forth in claim 1, wherein the plastic deformation is applied while increasing the temperature of the metallic material from a temperature below the transformation point to the point beyond the transformation point.

20. A method as set forth in claim 8, wherein the plastic deformation is applied while increasing the temperature of the steel material from a temperature below the $Ac_1$ point to the point beyond $Ac_1$ the point.

21. A method as set forth in claim 1, wherein an amount of strain introduced into the metallic material during the plastic deformation is at least 20%.

22. A method as set forth in claim 8, wherein the strain introduced into the steel material during the plastic deformation is effected by rolling the steel material.

23. A method as set forth in claim 1, wherein an amount of strain introduced into the metallic material during the plastic deformation is at least 50%.

24. A method as set forth in claim 8, wherein an amount of strain introduced into the steel material during the plastic deformation is at least 50%.

25. A method as set forth in claim 8, wherein the deformation is applied to the steel material while increasing the temperature to no higher than the $Ac_3$ point.

26. The steel material as set forth in claim 15, wherein the steel has a ferrite microstructure and a grain size less than 1 μm.

27. The steel material as set forth in claim 26, wherein the steel has a carbon content no greater than 0.02 wt. %.

28. The steel material as set forth in claim 15, wherein the steel has a bainite microstructure and a grain size less than 1 μm.

29. The steel material as set forth in claim 15, wherein the steel has a martensite microstructure and a grain size less than 1 μm.

30. The steel material as set forth in claim 15, wherein the steel has a pearlite microstructure and a grain size less than 1 μm.

* * * * *